US010072545B2

(12) United States Patent
Hirooka

(10) Patent No.: US 10,072,545 B2
(45) Date of Patent: Sep. 11, 2018

(54) EXHAUST PURIFICATION SYSTEM OF INTERNAL COMBUSTION ENGINE

(71) Applicant: TOYOTA JIDOSHA KABUSHIKI KAISHA, Toyota-shi, Aichi-ken (JP)

(72) Inventor: Shigemasa Hirooka, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 119 days.

(21) Appl. No.: 15/200,136

(22) Filed: Jul. 1, 2016

(65) Prior Publication Data

US 2017/0009624 A1 Jan. 12, 2017

(30) Foreign Application Priority Data

Jul. 6, 2015 (JP) ..... 2015-135217

(51) Int. Cl.

| | |
|---|---|
| ***F01N 3/08*** | (2006.01) |
| ***F01N 3/10*** | (2006.01) |
| ***F01N 3/20*** | (2006.01) |
| ***F02D 41/02*** | (2006.01) |
| ***F02D 41/14*** | (2006.01) |

(52) U.S. Cl.

CPC ..... *F01N 3/20* (2013.01); *F01N 3/0885* (2013.01); *F01N 3/101* (2013.01); *F02D 41/0295* (2013.01); *F02D 41/146* (2013.01); *F02D 41/1454* (2013.01); *F01N 2900/0416* (2013.01); *F01N 2900/1402* (2013.01); *F01N 2900/1624* (2013.01); *F02D 2200/0814* (2013.01)

(58) Field of Classification Search

CPC ..... F01N 3/0885; F01N 3/101; F01N 3/20; F01N 2900/0416; F01N 2900/1402; F01N 2900/1624; F02D 41/0295; F02D 41/1454; F02D 41/146; F02D 2200/0814

See application file for complete search history.

(56) References Cited

U.S. PATENT DOCUMENTS

| | | | | |
|---|---|---|---|---|
| 2004/0187479 | A1* | 9/2004 | Surnilla | F01N 3/0814 60/285 |
| 2006/0137326 | A1* | 6/2006 | Saito | F01N 11/007 60/277 |
| 2015/0086428 | A1 | 3/2015 | Kitaura et al. | |
| 2015/0322878 | A1 | 11/2015 | Okazaki et al. | |

FOREIGN PATENT DOCUMENTS

| | | | |
|---|---|---|---|
| DE | 102004009211 | A1 | 10/2004 |
| JP | H05-113157 | A | 5/1993 |
| JP | 2002-339737 | A | 11/2002 |
| JP | 2005-226491 | A | 8/2005 |
| JP | 2014-074385 | A | 4/2014 |
| JP | 2015-086861 | A | 5/2015 |
| WO | 2014/118890 | A1 | 8/2014 |
| WO | 2015076421 | A1 | 5/2015 |

* cited by examiner

*Primary Examiner* — Brandon Lee

(74) *Attorney, Agent, or Firm* — Hunton Andrews Kurth LLP

(57) ABSTRACT

An exhaust purification system of an internal combustion engine having an upstream side catalyst a downstream side catalyst, a downstream side air-fuel ratio sensor provided between the upstream side catalyst and the downstream side catalyst, and a control device able to control an air-fuel ratio of exhaust gas flowing into the upstream side catalyst as air-fuel ratio control.

10 Claims, 14 Drawing Sheets

EXHAUST PURIFICATION SYSTEM OF INTERNAL COMBUSTION ENGINE

TECHNICAL FIELD

Embodiments of the present invention relate to an exhaust purification system of an internal combustion engine.

BACKGROUND ART

The exhaust purification system of an internal combustion engine described in WO2014/118890A comprises an upstream side exhaust purification catalyst provided in an exhaust passage of the internal combustion engine, a downstream side exhaust purification catalyst provided at the downstream side of the upstream side exhaust purification catalyst in the direction of flow of exhaust in the exhaust passage, a downstream side air-fuel ratio sensor provided between the upstream side exhaust purification catalyst and the downstream side exhaust purification catalyst in the exhaust passage, and a control device able to control the air-fuel ratio of the exhaust gas flowing into the upstream side exhaust purification catalyst as "air-fuel ratio control".

In the exhaust purification system described in WO2014/118890A, in the air-fuel ratio control, when the output air-fuel ratio of the downstream side air-fuel ratio sensor is a rich judged air-fuel ratio or less, the air-fuel ratio of the exhaust gas flowing into the upstream side exhaust purification catalyst is switched to an air-fuel ratio leaner than the stoichiometric air-fuel ratio (below, referred to as a "lean air-fuel ratio"). In addition, when the oxygen storage amount of the upstream side exhaust purification catalyst becomes a switching reference storage amount smaller than a maximum storable amount of oxygen or becomes larger, the air-fuel ratio of the exhaust gas flowing into the upstream side exhaust purification catalyst is switched to an air-fuel ratio richer than the stoichiometric air-fuel ratio (below, referred to as a "rich air-fuel ratio"). By executing such air-fuel ratio control, it is considered possible to keep $NO_X$ from flowing out from the upstream side exhaust purification catalyst.

By executing the above-mentioned air-fuel ratio control, $NO_X$ will never flow out from the upstream side exhaust purification catalyst, but unburned gas (HC, CO, etc.) will sometimes flow out. For this reason, unburned gas will periodically flow into the downstream side exhaust purification catalyst and the oxygen storage amount of the downstream side exhaust purification catalyst will gradually fall. On the other hand, in most internal combustion engines, the feed of fuel from a fuel injector is temporarily stopped during operation of the internal combustion engine in accordance with the engine operating state as "fuel cut control". If such fuel cut control is executed, the oxygen storage amount of the downstream side exhaust purification catalyst will increase up to the maximum storable amount of oxygen. Therefore, if fuel cut control is periodically executed, due to the above-mentioned air-fuel ratio control, even if the oxygen storage amount of the downstream side exhaust purification catalyst falls, it will never reach close to zero.

In this regard, depending on the engine operating state, sometimes fuel cut control is not executed for a long time period. In this case, the oxygen storage amount of the downstream side exhaust purification catalyst falls and finally the unburned gas which flows out from the upstream side exhaust purification catalyst ends up being unable to be sufficiently removed at the downstream side exhaust purification catalyst. Therefore, in the exhaust purification system described in WO2014/118890A, when the oxygen storage amount of the downstream side exhaust purification catalyst becomes smaller, the air-fuel ratio of the exhaust gas flowing into the upstream side exhaust purification catalyst is continuously or intermittently made the lean air-fuel ratio. Due to this, the oxygen storage amount of the upstream side exhaust purification catalyst reaches the maximum storable amount of oxygen and exhaust gas containing oxygen or $NO_X$ flows out from the upstream side exhaust purification catalyst. According to the exhaust purification system described in WO2014/118890A, as a result, it is considered possible to make the oxygen storage amount of the downstream side exhaust purification catalyst increase and restore the ability of the upstream side exhaust purification catalyst to purify the unburned gas.

SUMMARY

In this regard, if the oxygen storage amount of the downstream side exhaust purification catalyst falls to a certain extent or less, unburned HC is physically adsorbed on the surface of the precious metal carried on the downstream side exhaust purification catalyst (HC poisoning). If the downstream side exhaust purification catalyst suffers from such HC poisoning, the reactivity on the downstream side exhaust purification catalyst falls. Therefore, even if a large amount of oxygen or $NO_X$ flows into the downstream side exhaust purification catalyst, the oxygen or $NO_X$ is not sufficiently removed from the exhaust gas. Part flows out from the downstream side exhaust purification catalyst.

In the exhaust purification system described in WO2014/118890A, when the oxygen storage amount of the downstream side exhaust purification catalyst becomes smaller, even after the oxygen storage amount of the upstream side exhaust purification catalyst reaches the maximum storable amount of oxygen, the air-fuel ratio of the exhaust gas flowing into the upstream side exhaust purification catalyst is made the lean air-fuel ratio. For this reason, a large amount of oxygen or $NO_X$ flows out from the upstream side exhaust purification catalyst and therefore a large amount of oxygen or $NO_X$ flows into the downstream side exhaust purification catalyst. However, if the downstream side exhaust purification catalyst suffers from HC poisoning, the oxygen or $NO_X$ in the inflowing exhaust gas can no longer be fully removed. Part may flow out from the downstream side exhaust purification catalyst.

Therefore, embodiments of the present invention, in view of the above problem, provide an exhaust purification system of an internal combustion engine which can keep $NO_X$ from flowing out from the downstream side exhaust purification catalyst.

Examples of embodiments of the present invention are as follows.

A first embodiment provides an exhaust purification system of an internal combustion engine comprising: an upstream side catalyst provided in an exhaust passage of the internal combustion engine; a downstream side catalyst provided at a downstream side from the upstream side catalyst in the direction of exhaust flow in the exhaust passage; a downstream side air-fuel ratio sensor provided between the upstream side catalyst and the downstream side catalyst in the exhaust passage; and a control device configured to be able to control the air-fuel ratio of the exhaust gas flowing into the upstream side catalyst as air-fuel ratio control, wherein the control device is further configured to: switch the air-fuel ratio of the exhaust gas flowing into the upstream side catalyst to a lean air-fuel ratio leaner than the stoichiometric air-fuel ratio when the output air-fuel ratio of the downstream side air-fuel ratio sensor becomes a constant rich judged air-fuel ratio richer than the stoichiometric air-fuel ratio or becomes less and switch the air-fuel ratio of the exhaust gas flowing into the upstream side catalyst to a rich air-fuel ratio richer than the stoichiometric air-fuel ratio when the oxygen storage amount of the upstream side catalyst becomes a switching reference storage amount smaller than the maximum storable amount of oxygen or becomes more in the air-fuel ratio control. The control device is also configured to make the concentration of $NO_X$ in the exhaust gas flowing into the upstream side catalyst increase without making the concentration of oxygen in the exhaust gas flowing out from the upstream side catalyst increase as control for increasing $NO_X$ when the oxygen storage amount of the downstream side catalyst becomes a predetermined limit storage amount smaller than the maximum storable amount of oxygen or becomes less during the air-fuel ratio control.

A second embodiment provides an exhaust purification system of an internal combustion engine according to the first embodiment, wherein the control device is further configured so as not to execute the control for increasing $NO_X$ even if the oxygen storage amount of the downstream side catalyst becomes the limit storage amount or less when the temperature of the downstream side catalyst is less than a predetermined temperature.

A third embodiment provides an exhaust purification system of an internal combustion engine according to the first or second embodiments, wherein the control device is further configured so as not to execute the control for increasing $NO_X$ even if the oxygen storage amount of the downstream side catalyst becomes the limit storage amount or less when the oxygen storage amount of the downstream side catalyst becomes the limit storage amount or less.

A fourth embodiment provides an exhaust purification system of an internal combustion engine according to any one of the first through third embodiments, wherein the control device is further configured to control the air-fuel ratio of the exhaust gas flowing into the upstream side catalyst in the air-fuel ratio control so that the air-fuel ratio of the exhaust gas flowing out from the upstream side catalyst does not become a constant lean judged air-fuel ratio or more leaner than the stoichiometric air-fuel ratio, and wherein the lean judged air-fuel ratio is a lean air-fuel ratio with a difference from the stoichiometric air-fuel ratio equal to the difference between the rich judged air-fuel ratio and the stoichiometric air-fuel ratio.

A fifth embodiment provides an exhaust purification system of an internal combustion engine according to any one of the first through fourth embodiments further comprising a spark plug igniting an air-fuel mixture in a combustion chamber of the internal combustion engine, wherein the control device is further configured to make the timing of ignition of the air-fuel mixture by the spark plug advance and thereby make the concentration of $NO_X$ in the exhaust gas flowing into the upstream side catalyst increase in the control for increasing $NO_X$.

A sixth embodiment provides an exhaust purification system of an internal combustion engine according to any one of the first through fifth embodiments further comprising an EGR mechanism feeding part of the exhaust gas discharged from a combustion chamber of the internal combustion engine to the combustion chamber again, wherein the control device is further configured to use the EGR mechanism to make the amount of exhaust gas again fed to the combustion chamber decrease and thereby make the concentration of $NO_X$ in exhaust gas flowing into the upstream side catalyst increase in the control for increasing $NO_X$.

A seventh embodiment provides an exhaust purification system of an internal combustion engine according to any one of the first through sixth embodiments further comprising: a cylinder fuel injector directly injecting fuel into a combustion chamber; and an intake passage fuel injector injecting fuel into an intake passage of the internal combustion engine, wherein the control device is further configured to: be able to change a ratio of an amount of feed of fuel from the intake passage fuel injector to an amount of feed of fuel from the cylinder fuel injector, defined as an intake passage injection ratio; and make the intake passage injection rate increase and thereby make a concentration of $NO_X$ flowing into the upstream side catalyst increase in the control for increasing $NO_X$.

According to embodiments of the present invention, it is possible to keep $NO_X$ from flowing out from the downstream side exhaust purification catalyst.

DESCRIPTION OF EMBODIMENTS

Figure 1:
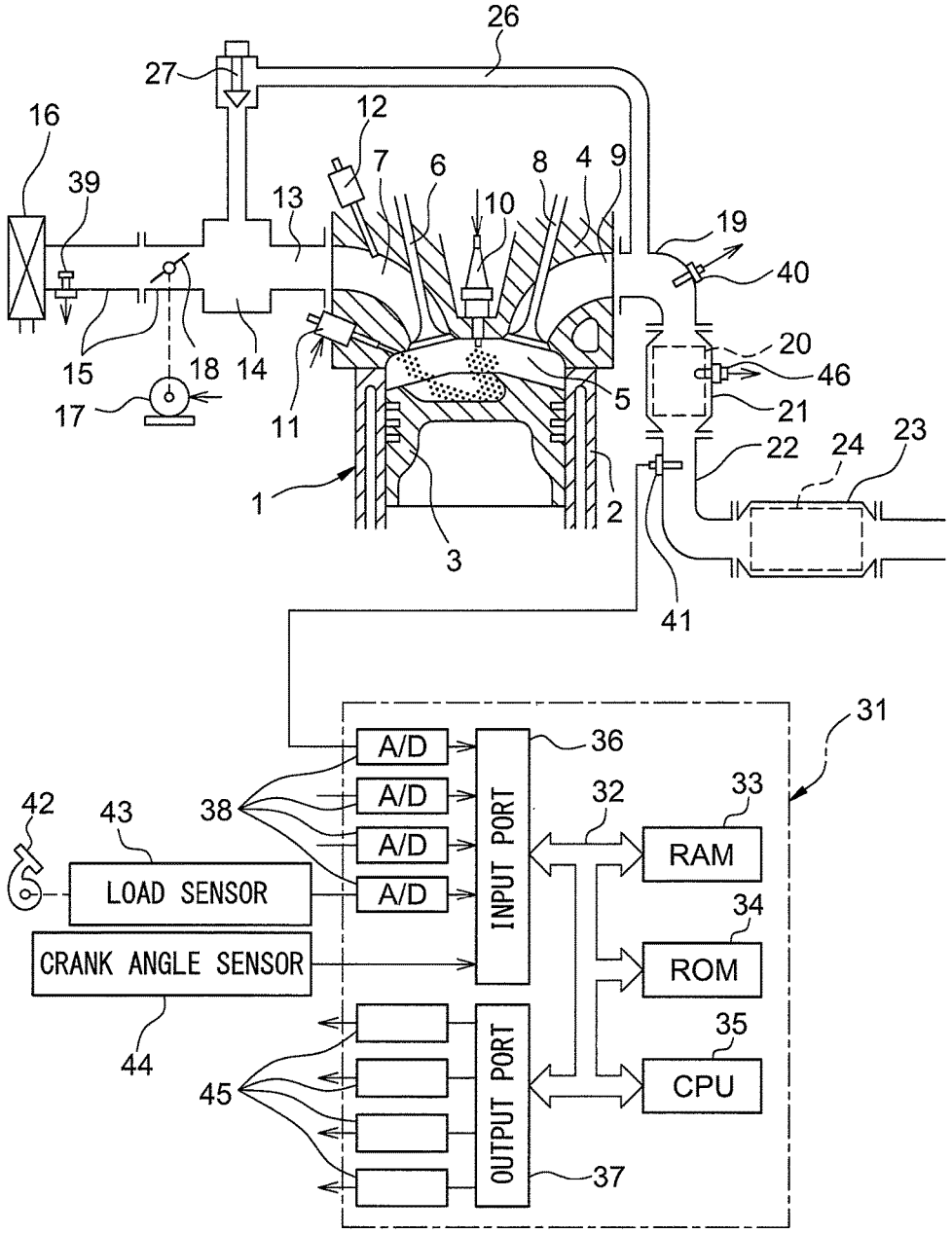
FIG. 1 is a view schematically showing an internal combustion engine according to an embodiment of the present invention.

Below, referring to the drawings, embodiments of the present invention will be explained in detail. Note that, in the following explanation, similar components are assigned the same reference numerals.

<Explanation of Internal Combustion Engine as a Whole>

FIG. 1 is a view which schematically shows an internal combustion engine in which an exhaust purification system according to a first embodiment of the present invention is used. Referring to FIG. 1, 1 indicates an engine body, 2 a cylinder block, 3 a piston which reciprocates in the cylinder block 2, 4 a cylinder head which is fastened to the cylinder block 2, 5 a combustion chamber which is formed between the piston 3 and the cylinder head 4, 6 an intake valve, 7 an intake port, 8 an exhaust valve, and 9 an exhaust port. The intake valve 6 opens and closes the intake port 7, while the exhaust valve 8 opens and closes the exhaust port 9.

As shown in FIG. 1, a spark plug 10 is arranged at a center part of an inside wall surface of the cylinder head 4, while a cylinder fuel injector 11 which directly injects and feeds fuel into a cylinder is arranged at a peripheral part of the inner wall surface of the cylinder head 4. In addition, a port fuel injector (an intake passage fuel injector) 12 which injects and feeds fuel into the intake port (i.e. intake passage) 7 is arranged at the periphery of the intake port 7. The spark plug 10 is configured to generate a spark in accordance with an ignition signal. Further, the cylinder fuel injector 11 and the port fuel injector 12 respectively inject a predetermined amount of fuel in accordance with an injection signal. Note that, only one of the cylinder fuel injector 11 and the port fuel injector 12 may also be arranged. Further, in the present embodiment, as the fuel, gasoline with a stoichiometric air-fuel ratio of 14.6 is used. However, the internal combustion engine in which an embodiment of an exhaust purification system of the present invention is used may also use fuel other than gasoline and blended fuel including gasoline as the fuel.

The intake port 7 of each cylinder is connected to a surge tank 14 through a corresponding intake runner 13, while the surge tank 14 is connected to an air cleaner 16 through an intake pipe 15. The intake port 7, intake runner 13, surge tank 14, and intake pipe 15 form an intake passage. Further, inside the intake pipe 15, a throttle valve 18 which is driven by a throttle valve drive actuator 17 is arranged. The throttle valve 18 can be operated by the throttle valve drive actuator 17 to thereby change the aperture area of the intake passage.

On the other hand, the exhaust port 9 of each cylinder is connected to an exhaust manifold 19. The exhaust manifold 19 has a plurality of runners which are connected to the exhaust ports 9 and a collected part at which these runners are collected. The collected part of the exhaust manifold 19 is connected to an upstream side casing 21 which houses an upstream side exhaust purification catalyst 20. The upstream side casing 21 is connected through an exhaust pipe 22 to a downstream side casing 23 which houses a downstream side exhaust purification catalyst 24. The exhaust manifold 19 and the surge tank 14 are connected through a recirculation exhaust gas (hereinafter, referred to as "EGR gas") conduit 26 to each other. Inside the EGR gas conduit 26, an EGR control valve 27 is arranged. The exhaust port 9, exhaust manifold 19, upstream side casing 21, exhaust pipe 22, and downstream side casing 23 form an exhaust passage.

The electronic control unit (ECU) 31 is comprised of a digital computer which is provided with components which are connected together through a bidirectional bus 32 such as a RAM (random access memory) 33, ROM (read only memory) 34, CPU (microprocessor) 35, input port 36, and output port 37. In the intake pipe 15, an airflow meter 39 is arranged for detecting the flow rate of air flowing through the intake pipe 15. The output of this airflow meter 39 is input through a corresponding AD converter 38 to the input port 36. Further, at the collected part of the exhaust manifold 19, an upstream side air-fuel ratio sensor 40 is arranged which detects the air-fuel ratio of the exhaust gas flowing through the inside of the exhaust manifold 19 (that is, the exhaust gas flowing into the upstream side exhaust purification catalyst 20). In addition, in the exhaust pipe 22, a downstream side air-fuel ratio sensor 41 is arranged which detects the air-fuel ratio of the exhaust gas flowing through the inside of the exhaust pipe 22 (that is, the exhaust gas flowing out from the upstream side exhaust purification catalyst 20 and flowing into the downstream side exhaust purification catalyst 24). The outputs of these air-fuel ratio sensors 40 and 41 are also input through the corresponding AD converters 38 to the input port 36.

Further, an accelerator pedal 42 is connected to a load sensor 43 generating an output voltage which is proportional to the amount of depression of the accelerator pedal 42. The output voltage of the load sensor 43 is input to the input port 36 through a corresponding AD converter 38. The crank angle sensor 44 generates an output pulse every time, for example, a crankshaft rotates by 15 degrees. This output pulse is input to the input port 36. The CPU 35 calculates the engine speed from the output pulse of this crank angle sensor 44. On the other hand, the output port 37 is connected through corresponding drive circuits 45 to the spark plugs 10, the cylinder fuel injector 11, the port fuel injector 12, and the throttle valve drive actuator 17. Note that the ECU 31 functions as a control device for controlling the internal combustion engine and the exhaust purification system.

<Explanation of Exhaust Purification Catalyst>

The upstream side exhaust purification catalyst 20 and the downstream side exhaust purification catalyst 24 are three-way catalysts having oxygen storage abilities. Specifically, the exhaust purification catalysts 20 and 24 are three-way catalysts comprised of carriers made of ceramic on which precious metals having catalytic actions (for example, platinum (Pt)) and substances having oxygen storage abilities (for example, ceria ($CeO_2$)) are carried. The three-way catalysts have the functions of simultaneously removing unburned HC and CO and $NO_X$ if the air-fuel ratios of the exhaust gas flowing into the three-way catalysts are maintained at the stoichiometric air-fuel ratio. In addition, when the exhaust purification catalysts 20 and 24 store certain extents of oxygen, even if the air-fuel ratios of the exhaust gas flowing into the exhaust purification catalysts 20 and 24 deviate slightly to the rich side or lean side from the stoichiometric air-fuel ratio, the unburned HC and CO and $NO_X$ are simultaneously removed.

If the three-way catalysts 20 and 24 have oxygen storage abilities, (that is, if the oxygen storage amounts of the exhaust purification catalysts 20 and 24 are smaller than the maximum storable oxygen amount, after the air-fuel ratios of the exhaust gas flowing into the exhaust purification catalysts 20 and 24 become somewhat leaner than the stoichiometric air-fuel ratio), the excess oxygen contained in the exhaust gas is stored in the exhaust purification catalysts 20 and 24. Due to this, the surfaces of the exhaust purification catalysts 20 and 24 are maintained at the stoichiometric air-fuel ratio. As a result, the surfaces of the exhaust purification catalysts 20 and 24 are simultaneously cleaned of unburned HC and CO and $NO_X$. At this time, the air-fuel ratios of the exhaust gas discharged from the exhaust purification catalysts 20 and 24 become the stoichiometric air-fuel ratio.

On the other hand, if the exhaust purification catalysts 20 and 24 are in a state where they can release oxygen, (that is, if the oxygen storage amounts of the exhaust purification catalysts 20 and 24 are greater than zero, after the air-fuel ratios of the exhaust gas flowing into the exhaust purification catalysts 20 and 24 become somewhat richer than the stoichiometric air-fuel ratio), the insufficient amount of oxygen for reducing the exhaust gas contained in the exhaust gas is released from the exhaust purification catalysts 20 and 24. Due to this, the surfaces of the exhaust purification catalysts 20 and 24 are again maintained at the stoichiometric air-fuel ratio. As a result, the surfaces of the exhaust purification catalysts 20 and 24 are simultaneously cleaned of unburned HC and CO and $NO_X$. At this time, the air-fuel ratios of the exhaust gas flowing out from the exhaust purification catalysts 20 and 24 become the stoichiometric air-fuel ratio.

In this way, if the exhaust purification catalysts 20 and 24 store certain extents of oxygen, even if the air-fuel ratios of the exhaust gas flowing into the exhaust purification catalysts 20 and 24 deviate somewhat to the rich side or the lean side from the stoichiometric air-fuel ratio, the unburned HC and CO and $NO_X$ are simultaneously removed, and the air-fuel ratios of the exhaust gas flowing out from the exhaust purification catalysts 20 and 24 become the stoichiometric air-fuel ratio.

<Explanation of Air-Fuel Ratio Sensor>

Figure 2:
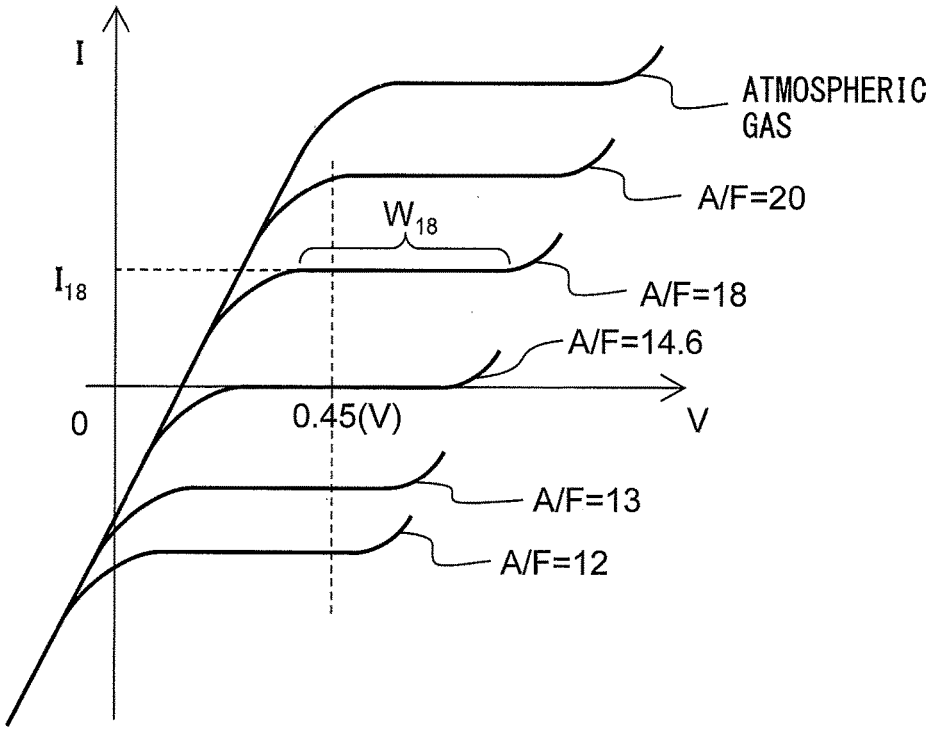
FIG. 2 is a view showing a relationship between a sensor applied voltage and output current at different exhaust air-fuel ratios.
Figure 3:
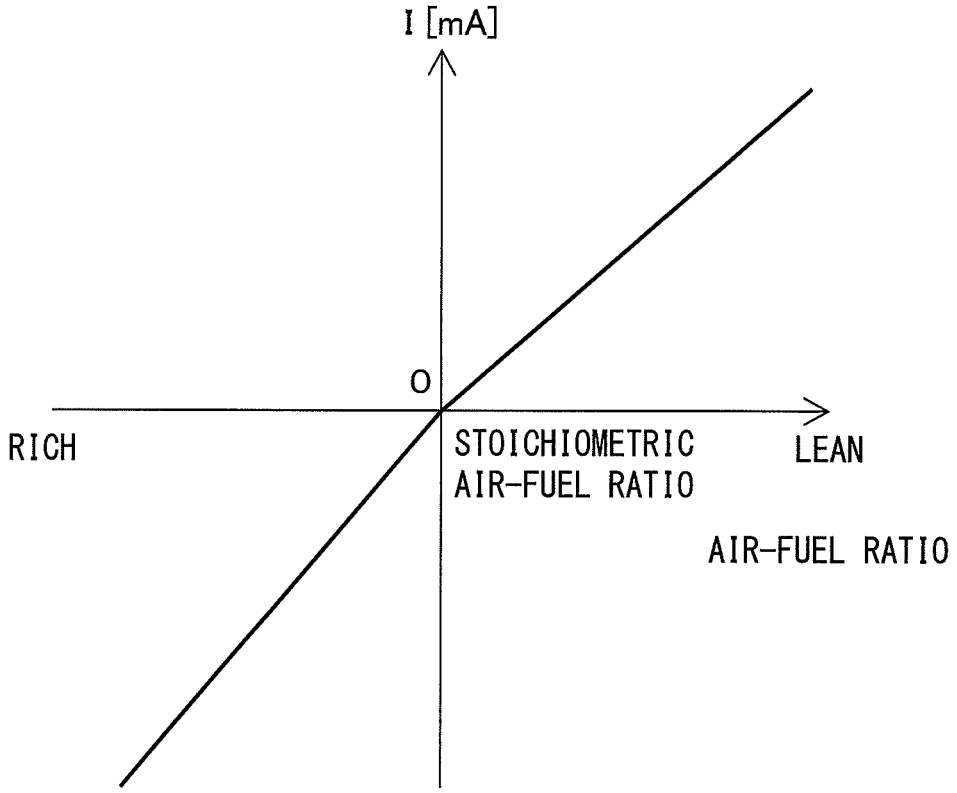
FIG. 3 is a view showing a relationship between an exhaust air-fuel ratio and output current when making a sensor applied voltage constant.

Next, referring to FIGS. 2 and 3, the output characteristic of air-fuel ratio sensors 40 and 41 in the present embodiment will be explained. FIG. 2 is a view showing the voltage-current (V-I) characteristic of the air-fuel ratio sensors 40 and 41 of the present embodiment. FIG. 3 is a view showing the relationship between air-fuel ratio of the exhaust gas (below, referred to as "exhaust air-fuel ratio") flowing around the air-fuel ratio sensors 40 and 41 and output current I, when making the supplied voltage constant. Note that, in this embodiment, the air-fuel ratio sensor having the same configurations is used as both air-fuel ratio sensors 40 and 41.

As will be understood from FIG. 2, in the air-fuel ratio sensors 40 and 41 of the present embodiment, the output current I becomes larger the higher (the leaner) the exhaust air-fuel ratio. Further, the line V-I of each exhaust air-fuel ratio has a region substantially parallel to the V axis, that is, a region where the output current does not change much at all even if the supplied voltage of the sensor changes. This voltage region is called the "limit current region". The current at this time is called the "limit current". In FIG. 2, the limit current region and limit current when the exhaust air-fuel ratio is 18 are shown by $W_{18}$ and $I_{18}$, respectively. Therefore, the air-fuel ratio sensors 40 and 41 can be referred to as "limit current type air-fuel ratio sensors".

FIG. 3 is a view which shows the relationship between the exhaust air-fuel ratio and the output current I when making the supplied voltage constant at about 0.45V. As will be understood from FIG. 3, in the air-fuel ratio sensors 40 and 41, the output current I varies linearly (proportionally) with respect to the exhaust air-fuel ratio such that the higher (that is, the leaner) the exhaust air-fuel ratio, the greater the output current I from the air-fuel ratio sensors 40 and 41. In addition, the air-fuel ratio sensors 40 and 41 are configured so that the output current I becomes zero when the exhaust air-fuel ratio is the stoichiometric air-fuel ratio.

Note that, in the above example, as the air-fuel ratio sensors 40 and 41, limit current type air-fuel ratio sensors are used. However, as the air-fuel ratio sensors 40 and 41, it is also possible to use air-fuel ratio sensor not a limit current type or any other air-fuel ratio sensor, as long as the output current varies linearly with respect to the exhaust air-fuel ratio. Further, the air-fuel ratio sensors 40 and 41 may have structures different from each other.

<Basic Air Fuel Ratio Control>

Next, an outline of the basic air-fuel ratio control in the exhaust purification system of an internal combustion engine of the present embodiment will be explained. In the air-fuel ratio control of the present embodiment, the fuel feed amount from the fuel injectors 11 and 12 is controlled by feedback based on the output air-fuel ratio of the upstream side air-fuel ratio sensor 40 so that the output air-fuel ratio of the upstream side air-fuel ratio sensor 40 becomes the target air-fuel ratio. In other words, in the air-fuel ratio control of the present embodiment, the feedback control is performed based on the output air-fuel ratio of the upstream side air-fuel ratio sensor 40 so that the air-fuel ratio of the exhaust gas flowing into the exhaust purification catalysts 20 becomes the target air-fuel ratio. Note that, "output air-fuel ratio" means an air-fuel ratio corresponding to the output value of an air-fuel ratio sensor.

Furthermore, in the air-fuel ratio control of the present embodiment, a target air-fuel ratio is set based on, for example, the output air-fuel ratio of the downstream side air-fuel ratio sensor 41. Specifically, when the output air-fuel ratio of the downstream side air-fuel ratio sensor 41 becomes the rich air-fuel ratio, the target air-fuel ratio is set to the lean set air-fuel ratio. As the result, the air-fuel ratio of the exhaust gas flowing into the exhaust purification catalyst 20 also becomes the air-fuel ration equal to a lean set air-fuel ratio. In this regard, the lean set air-fuel ratio is a predetermined air-fuel ratio of which is a fixed value and is leaner by a certain extent than the stoichiometric air-fuel ratio (an air-fuel ratio serving as the center of control). For example, it is approximately 14.65 to 16. Further, the lean set air-fuel ratio can be expressed as an air-fuel ratio obtained by adding the lean correction amount to the air-fuel ratio serving as the center of control (in the present embodiment, stoichiometric air-fuel ratio). Further, in the present embodiment, it is judged that the output air-fuel ratio of the downstream side air-fuel ratio sensor 41 becomes the rich air-fuel ratio, when the output air-fuel ratio of the downstream side air-fuel ratio sensor 41 becomes a rich judgement air-fuel ratio which is slightly richer than the stoichiometric air-fuel ratio (for example, 14.55) or less.

If the target air-fuel ratio is changed to the lean set air-fuel ratio, the oxygen excess/deficiency of the exhaust gas flowing into the upstream side exhaust purification catalyst 20 is cumulatively added. The "oxygen excess/deficiency" means the amount of oxygen which becomes excessive or the amount of oxygen which becomes deficient (for example, an amount of excess unburned HC or CO (below, also referred to as the "unburned gas")) when trying to make the air-fuel ratio of the exhaust gas flowing into the upstream side exhaust purification catalyst 20 the stoichiometric air-fuel ratio. In particular, when the target air-fuel ratio is the lean set air-fuel ratio, the exhaust gas flowing into the upstream side exhaust purification catalyst 20 becomes excessive in oxygen. This excess oxygen is stored in the upstream side exhaust purification catalyst 20. Therefore, the cumulative value of the oxygen excess/deficiency (below, also referred to as the "cumulative oxygen excess/deficiency") can be said to be the estimated value of the stored amount of oxygen OSA of the upstream side exhaust purification catalyst 20.

Note that, the oxygen excess/deficiency is calculated based on the output air-fuel ratio of the upstream side air-fuel ratio sensor 40 and the estimated value of the intake air amount to the inside of the combustion chamber 5 which is calculated based on, for example, the output of the airflow meter 39 or the fuel feed amount of the fuel injectors 11, 12. Specifically, the oxygen excess/deficiency OEDsc is, for example, calculated by the following formula (1):

$$ODEsc=0.23*Qi*(AFup-AFR) \quad (1)$$

where 0.23 indicates the concentration of oxygen in the air, Qi indicates the amount of fuel injection, and AFup indicates the output air-fuel ratio of the upstream side air-fuel ratio sensor 40 and AFR indicates the air-fuel ratio serving as the center of control (in the present embodiment, basically stoichiometric air-fuel ratio).

If the cumulative oxygen excess/deficiency which is cumulative value of the thus calculated oxygen excess/deficiency becomes the predetermined switching reference value (corresponding to predetermined switching reference storage amount Cref) or more, the target air-fuel ratio which had up to then been set to the lean set air-fuel ratio is set to a rich set air-fuel ratio. As the result, the air-fuel ratio of the exhaust gas flowing into the exhaust purification catalyst 20 also becomes the air-fuel ration equal to the rich set air-fuel ratio.

The rich set air-fuel ratio is a predetermined air-fuel ratio which is a certain degree richer than the stoichiometric air-fuel ratio (air-fuel ratio serving as the center of control). For example, it is approximately 14 to 14.55. Further, the rich set air-fuel ratio can be expressed as an air-fuel ratio obtained by adding a negative air-fuel ratio correction amount from the air-fuel ratio serving as the center of control (in the present embodiment, stoichiometric air-fuel ratio). Note that, in the present embodiment, the difference between the rich set air-fuel ratio and the stoichiometric air-fuel ratio (rich degree) is the difference between the lean set air-fuel ratio and the stoichiometric air-fuel ratio (lean degree) or less.

After the output air-fuel ratio of the downstream side air-fuel ratio sensor 41 again becomes the rich judgment air-fuel ratio or less, the target air-fuel ratio is again set to the lean set air-fuel ratio. After this, a similar operation is repeated. In this way, in the present embodiment, the target air-fuel ratio of the exhaust gas flowing into the upstream side exhaust purification catalyst 20 is alternately set to the lean set air-fuel ratio and the rich set air-fuel ratio. In other words, in the present embodiment, the air-fuel ratio of the exhaust gas flowing into the exhaust purification catalyst 20 is alternately switched to the lean air-fuel ratio and the rich air-fuel ratio.

<Explanation of Air Fuel Ratio Control Using Time Chart>

Figure 4:
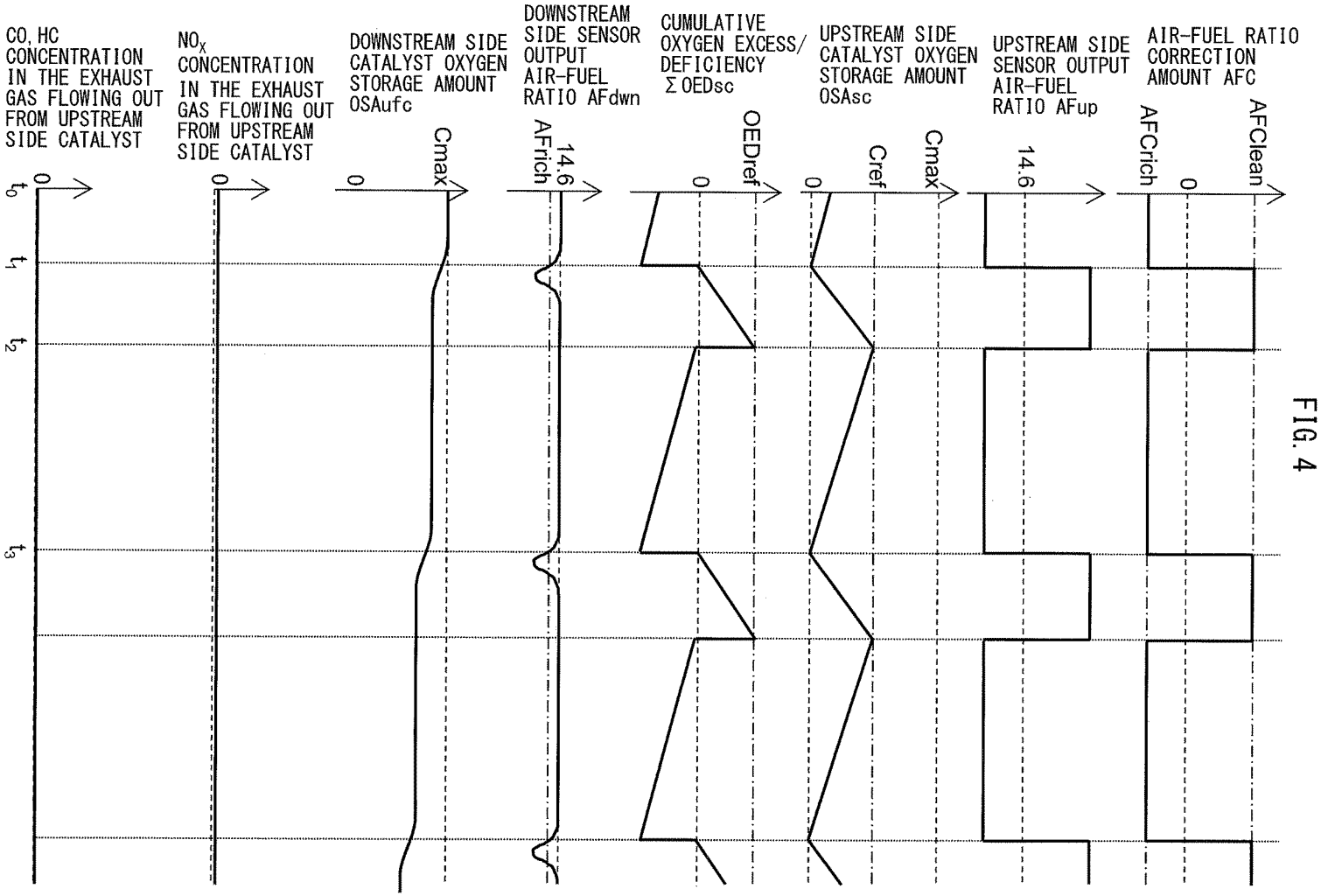
FIG. 4 is a time chart of an air-fuel ratio correction amount when executing air-fuel ratio control.

Referring to FIG. 4, the operation explained as above will be explained in more detail. FIG. 4 is a time chart of an air-fuel ratio correction amount AFC, an output air-fuel ratio AFup of the upstream side air-fuel ratio sensor 40, a stored amount of oxygen OSAsc of the upstream side exhaust purification catalyst 20, a cumulative oxygen excess/deficiency ΣOEDsc of the exhaust gas flowing into the upstream side exhaust purification catalyst 20, an output air-fuel ratio AFdwn of the downstream side air-fuel ratio sensor 41, a stored amount of oxygen OSAufc of the downstream side exhaust purification catalyst 24, the concentration of $NO_X$ in the exhaust gas flowing out from the upstream side exhaust purification catalyst 20, and the concentration of HC, CO in the exhaust gas flowing out from the downstream side exhaust purification catalyst 24, when performing the air-fuel ratio control of the present embodiment.

Note that, the air-fuel ratio correction amount AFC is a correction amount relating to the target air-fuel ratio of the exhaust gas flowing into the upstream side exhaust purification catalyst 20. If the air-fuel ratio correction amount AFC is 0, the target air-fuel ratio is set to the air-fuel ratio equal to the air-fuel ratio serving as center of control (below, referred to as "control center air-fuel ratio") (in this embodiment, stoichiometric air-fuel ratio). If the air-fuel ratio correction amount AFC is a positive value, the target air-fuel ratio becomes an air-fuel ratio leaner than the control center air-fuel ratio (in this embodiment, a lean air-fuel ratio), and if the air-fuel ratio correction amount AFC is a negative value, the target air-fuel ratio becomes an air-fuel ratio richer than the control center air-fuel ratio (in this embodiment, a rich air-fuel ratio).

In the illustrated example, in the state before a time $t_1$, the air-fuel correction amount AFC is set to a predetermined constant rich set correction amount AFCrich (corresponding to the rich set air-fuel ratio). That is, the target air-fuel ratio is set to a rich air-fuel ratio. Along with this, the output air-fuel ratio of the upstream side air-fuel ratio sensor 40 becomes a rich air-fuel ratio. Unburned gas and the like contained in the exhaust gas flowing into the upstream side exhaust purification catalyst 20 is purified by the upstream side exhaust purification catalyst 20, and along with this the upstream side exhaust purification catalyst 20 is gradually decreased in the stored amount of oxygen OSAsc. The amount of unburned gas and the like in the exhaust gas flowing into the upstream side exhaust purification catalyst 20 is decreased by the purification at the upstream side exhaust purification catalyst 20, and therefore the output air-fuel ratio AFdwn of the downstream side air-fuel ratio sensor 41 becomes substantially stoichiometric air-fuel ratio. Further, since the air-fuel ratio of the exhaust gas flowing into the upstream side exhaust purification catalyst 20 becomes the rich air-fuel ratio, the amount of $NO_X$ exhausted from the upstream side exhaust purification catalyst 20 are reduced.

If the upstream side exhaust purification catalyst 20 gradually decreases in stored amount of oxygen OSAsc, the stored amount of oxygen OSAsc approaches zero. Along with this, part of the unburned gas and the like flowing into the upstream side exhaust purification catalyst 20 starts to flow out without being purified by the upstream side exhaust purification catalyst 20. Due to this, the output air-fuel ratio AFdwn of the downstream side air-fuel ratio sensor 41 gradually falls and the output air-fuel ratio AFdwn of the downstream side air-fuel ratio sensor 41 reaches the rich judgment air-fuel ratio AFrich at the time $t_1$.

In the present embodiment, when the output air-fuel ratio AFdwn of the downstream side air-fuel ratio sensor 41 becomes the rich judgment air-fuel ratio AFrich or less, to increase the stored amount of oxygen OSAsc, the air-fuel ratio correction amount AFC is switched to a predetermined constant lean set correction amount AFClean (corresponding to the lean set air-fuel ratio). Further, at this time, the cumulative oxygen excess/deficiency ΣOEDsc is reset to 0.

Note that, in the present embodiment, the air-fuel ratio correction amount AFC is switched after the output air-fuel ratio of the downstream side air-fuel ratio sensor 41 reaches the rich judgment air-fuel ratio. This is because even if the stored amount of oxygen of the upstream side exhaust purification catalyst 20 is sufficient, the air-fuel ratio of the exhaust gas flowing out from the upstream side exhaust purification catalyst 20 is sometimes slightly offset from the stoichiometric air-fuel ratio. Conversely speaking, the rich judgment air-fuel ratio is set to an air-fuel ratio which the air-fuel ratio of the exhaust gas flowing out from the upstream side exhaust purification catalyst 20 will never reach when the stored amount of oxygen of the upstream side exhaust purification catalyst 20 is sufficient.

If the target air-fuel ratio is switched to a lean air-fuel ratio at the time $t_1$, the air-fuel ratio of the exhaust gas flowing into the upstream side exhaust purification catalyst 20 changes from the rich air-fuel ratio to the lean air-fuel ratio. If at the time $t_1$ the air-fuel ratio of the exhaust gas flowing into the upstream side exhaust purification catalyst 20 changes to the lean air-fuel ratio, the upstream side exhaust purification catalyst 20 increases in the stored amount of oxygen OSAsc. Further, along with this, the cumulative oxygen excess/deficiency ΣOEDsc also gradually increases.

Due to this, the air-fuel ratio of the exhaust gas flowing out from the upstream side exhaust purification catalyst 20 changes to the stoichiometric air-fuel ratio, and the output air-fuel ratio AFdwn of the downstream side air-fuel ratio sensor 41 converges to the stoichiometric air-fuel ratio. At this time, the air-fuel ratio of the exhaust gas flowing into the upstream side exhaust purification catalyst 20 becomes the lean air-fuel ratio, but there is sufficient leeway in the oxygen storage ability of the upstream side exhaust purification catalyst 20, and therefore the oxygen in the inflowing exhaust gas is stored in the upstream side exhaust purification catalyst 20 and the $NO_X$ is reduced and purified. Therefore, the exhaust amount of NOx from the upstream side exhaust purification catalyst 20 is reduced.

After this, if the upstream side exhaust purification catalyst 20 increases in stored amount of oxygen OSAsc, at a time $t_2$, the stored amount of oxygen OSAsc of the upstream side exhaust purification catalyst 20 reaches a switching reference storage amount Cref. For this reason, the cumulative oxygen excess/deficiency ΣOEDsc reaches a switching reference value OEDref which corresponds to the switching reference storage amount Cref. In the present embodiment, if the cumulative oxygen excess/deficiency ΣOEDsc becomes the switching reference value OEDref or more, in order to suspend the storage of oxygen to the upstream side exhaust purification catalyst 20, the air-fuel ratio correction amount AFC is switched to a rich set air-fuel amount AFTrich. Therefore, the target air-fuel ratio is switched to a rich air-fuel ratio. Further, at this time, the cumulative oxygen excess/deficiency ΣOEDsc is reset to 0.

Note that switching reference storage amount Cref is made a sufficiently small amount so that even if sudden acceleration of the vehicle causes, for example, an unintentional deviation of the air-fuel ratio, the oxygen storage amount OSAsc does not reach a maximum storable oxygen amount Cmax. For example, the switching reference storage amount Cref is made ¾ or less of the maximum storable oxygen amount Cmax when the upstream side exhaust purification catalyst 20 is still unused, preferably ½ or less, more preferably ⅕ or less. As a result, the air-fuel ratio correction amount AFC is switched to the rich set correction amount AFCrich before the output air-fuel ratio AFdwn reaches a lean judged air-fuel ratio slightly leaner than the stoichiometric air-fuel ratio (for example, 14.65) (a lean air-fuel ratio where the difference from the stoichiometric air-fuel ratio becomes the same as the difference between rich judged air-fuel ratio and stoichiometric air-fuel ratio). That is, the present air-fuel ratio control can be said to control the air-fuel ratio of the exhaust gas flowing into said upstream side catalyst so that the air-fuel ratio of the exhaust gas flowing out from the upstream side exhaust purification catalyst 20 does not becomes a certain lean judged air-fuel ratio or more.

If at the time $t_2$ switching the target air-fuel ratio to the rich air-fuel ratio, the air-fuel ratio of the exhaust gas flowing into the upstream side exhaust purification catalyst 20 changes from the lean air-fuel ratio to the rich air-fuel ratio. The exhaust gas flowing into the upstream side exhaust purification catalyst 20 contains, for example, unburned gas, so the oxygen storage amount OSAsc of the upstream side exhaust purification catalyst 20 gradually decreases. The discharge of $NO_X$ from the upstream side exhaust purification catalyst 20 at this time becomes substantially zero.

If the oxygen storage amount OSAsc of the upstream side exhaust purification catalyst 20 gradually decreases, at a time $t_3$, in the same way as the time $t_1$, the output air-fuel ratio AFdwn of the downstream side air-fuel ratio sensor 41 reaches the rich judged air-fuel ratio AFrich. Due to this, the air-fuel ratio correction amount AFC is switched to the lean set correction amount AFClean. After that, the cycle of the above-mentioned $t_1$ to $t_3$ is repeated.

As will be understood from the above explanation, according to the present embodiment, it is possible to constantly suppress the amount of $NO_X$ exhausted from the upstream side exhaust purification catalyst 20. That is, as long as performing the control explained above, the exhaust amount of NOx from the upstream side exhaust purification catalyst 20 can basically be nearly zero. Further, since the cumulative period for calculating the cumulative oxygen excess/deficiency ΣOEDsc is short, comparing with the case where the cumulative period is long, a possibility of error occurring is low. Therefore, it is suppressed that NOx is exhausted from the upstream side exhaust purification catalyst 20 due to the calculation error in the cumulative oxygen excess/deficiency ΣOEDsc.

Further, in general, if the stored amount of oxygen of the exhaust purification catalyst is maintained constant, the exhaust purification catalyst falls in oxygen storage ability. That is, it is necessary that the oxygen storage amount of the exhaust purification catalyst is varied in order to maintain the oxygen storage ability of the exhaust purification catalyst high. On the other hand, according to the present embodiment, as shown in FIG. 4, the stored amount of oxygen OSAsc of the upstream side exhaust purification catalyst 20 constantly fluctuates up and down, and therefore the oxygen storage ability is kept from falling.

Note that, in the above embodiment, the air-fuel ratio correction amount AFC is maintained to the lean set correction amount AFClean in the time $t_1$ to $t_2$. However, in this period, the air-fuel ratio correction amount AFC is not necessarily maintained constant, and can be set so as to vary, for example to be gradually reduced. Alternatively, in the period from the time $t_1$ to time $t_2$, the air-fuel ratio correction amount AFC may be temporally set to a value lower than 0 (for example, the rich set correction amount).

Similarly, in the above embodiment, the air-fuel ratio correction amount AFC is maintained to the rich set correction amount AFCrich in the time $t_2$ to $t_3$. However, in this period, the air-fuel ratio correction amount AFC is not necessarily maintained constant, and can be set so as to vary, for example to be gradually increased. Alternatively, in the period from the time $t_2$ to time $t_3$, the air-fuel ratio correction amount AFC may be temporally set to a value higher than 0 (for example, the lean set correction amount).

Note that, in the present embodiment, setting of the air-fuel ratio correction amount AFC, i.e., setting of the target air-fuel ratio, is performed by the ECU 31. Therefore, it can be said that when the air-fuel ratio of the exhaust gas detected by the downstream side air-fuel ratio sensor 41 becomes the rich judgment air-fuel ratio or less, the ECU 31 makes the target air-fuel ratio of the exhaust gas flowing into the upstream side exhaust purification catalyst 20 the lean air-fuel ratio continuously or intermittently until the stored amount of oxygen OSAsc of the upstream side exhaust purification catalyst 20 is estimated to become the switching reference storage amount Cref or more. If the stored amount of oxygen OSAsc of the upstream side exhaust purification catalyst 20 is estimated to becomes the switching reference storage amount Cref or more the ECU 31 makes the target air-fuel ratio the rich air-fuel ratio continuously or intermittently until the air-fuel ratio of the exhaust gas detected by the downstream side air-fuel ratio sensor 41 becomes the rich judgment air-fuel ratio or less without the stored amount of oxygen OSAsc reaching the maximum storable oxygen amount Cmax.

More simply speaking, in the present embodiment, it can be said that the ECU 31 switches the target air-fuel ratio (i.e. the air-fuel ratio of the exhaust gas flowing into the upstream side exhaust purification catalyst 20) to the lean air-fuel ratio after the air-fuel ratio detected by the downstream side air-fuel ratio sensor 41 becomes the rich judgment air-fuel ratio or less, and switches the target air-fuel ratio (i.e. the air-fuel ratio of the exhaust gas flowing into the upstream side exhaust purification catalyst 20) to the rich air-fuel ratio after the stored amount of oxygen OSAsc of the upstream side exhaust purification catalyst 20 becomes the switching reference storage amount Cref or more.

<Explanation of Air-Fuel Ratio Control Using Also Downstream Side Exhaust Purification Catalyst>

Further, in the present embodiment, in addition to the upstream side exhaust purification catalyst 20, a downstream side exhaust purification catalyst 24 is also provided. An oxygen storage amount OSAufc of the downstream side exhaust purification catalyst 24 becomes a value near the maximum storable oxygen amount Cmax by fuel cut control performed every certain extent of time period. For this reason, even if exhaust gas containing unburned gas flows out from the upstream side exhaust purification catalyst 20, the unburned gas is oxidized and purified at the downstream side exhaust purification catalyst 24.

Note that, "fuel cut control" means control which prevents fuel from being injected from the fuel injectors 11, 12 during operation of the internal combustion engine (that is, during rotation of the crankshaft), at a time of deceleration of a vehicle mounting the internal combustion engine. If performing such control, a large amount of air flows into the two exhaust purification catalysts 20, 24.

In the example which is shown in FIG. 4, fuel cut control is performed before a time $t_0$. For this reason, before the time $t_1$, the oxygen storage amount OSAufc of the downstream side exhaust purification catalyst 24 is a value near the maximum storable oxygen amount Cmax. Further, before the time $t_1$, the air-fuel ratio of the exhaust gas flowing out from the upstream side exhaust purification catalyst 20 is maintained at substantially the stoichiometric air-fuel ratio. For this reason, the oxygen storage amount OSAufc of the downstream side exhaust purification catalyst 24 is maintained constant.

After that, in part of the times $t_1$ to $t_2$, the air-fuel ratio of the exhaust gas flowing out from the upstream side exhaust purification catalyst 20 becomes the rich air-fuel ratio. For this reason, in this period, exhaust gas containing unburned gas flows into the downstream side exhaust purification catalyst 24.

However, as explained above, the downstream side exhaust purification catalyst 24 stores a large amount of oxygen. For this reason, if the exhaust gas flowing into the downstream side exhaust purification catalyst 24 contains unburned gas, the stored oxygen enables the unburned gas to be removed by oxidation. Further, along with this, the oxygen storage amount OSAufc of the downstream side exhaust purification catalyst 24 decreases. However, at the times $t_1$ to $t_2$, the unburned gas flowing out from the upstream side exhaust purification catalyst 20 does not become that great, so the amount of decrease of the oxygen storage amount OSAufc during this period is slight. For this reason, at the time $t_1$ to $t_2$, the unburned gas flowing out from the upstream side exhaust purification catalyst 20 is all removed by reduction in the downstream side exhaust purification catalyst 24.

At the time $t_3$ on as well, at each time interval of a certain extent, in the same way as for the times $t_1$ to $t_2$, unburned gas flows out from the upstream side exhaust purification catalyst 20. This outflowing unburned gas is basically removed by reduction by the oxygen which is stored in the downstream side exhaust purification catalyst 24.

<Effect of Reduction of Oxygen Storage Amount of Downstream Side Exhaust Purification Catalyst>

In this regard, fuel cut control is executed at the time of deceleration of a vehicle mounting an internal combustion engine, and therefore is not necessarily executed every certain time interval. For this reason, fuel cut control sometimes is not executed over a long time period. If unburned gas repeatedly flows out from the upstream side exhaust purification catalyst 20, an oxygen storage amount OSCufc of the downstream side exhaust purification catalyst 24 decreases toward zero. This situation is shown in FIG. 5.

Figure 5:
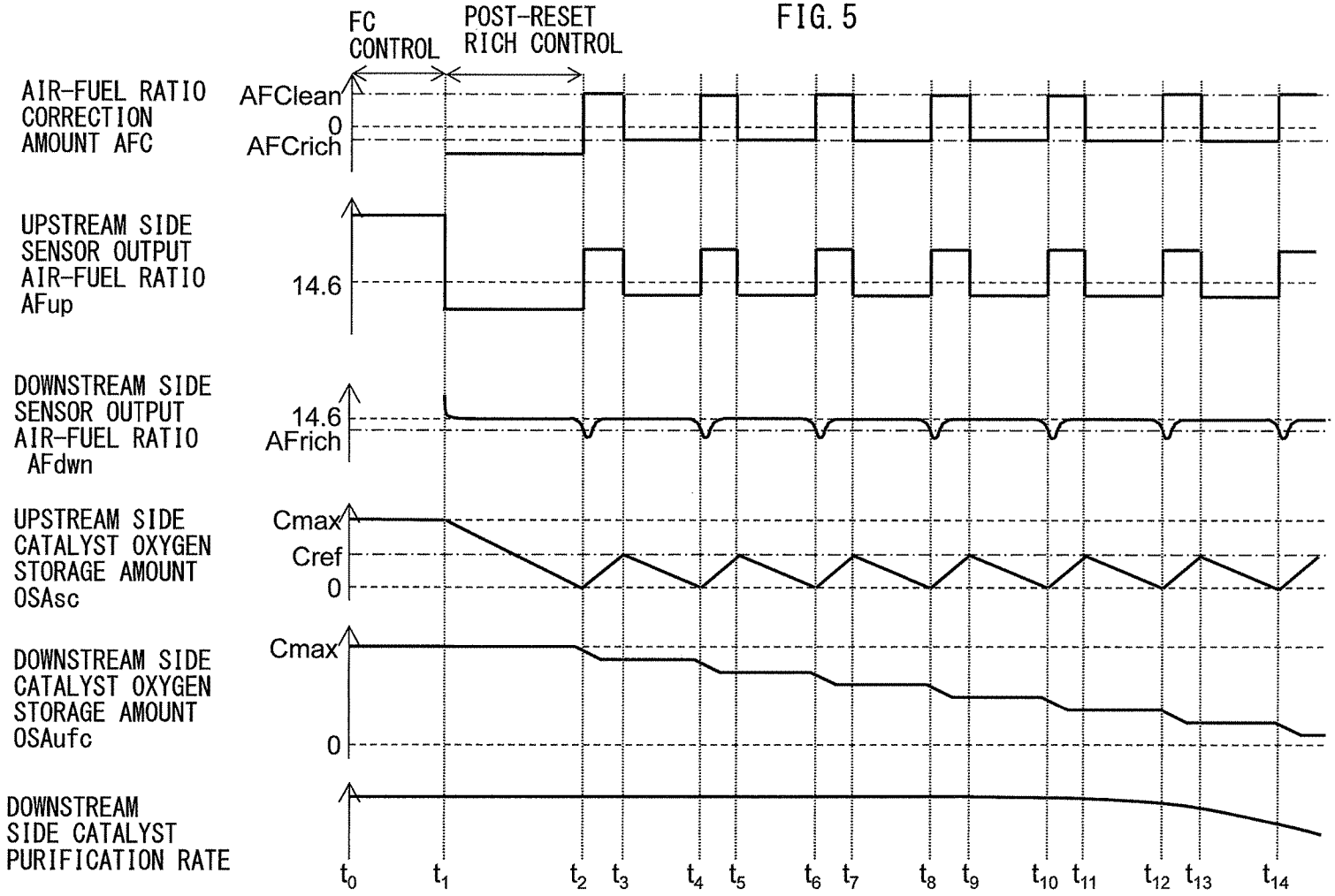
FIG. 5 is a time chart of an air-fuel ratio correction amount and an output air-fuel ratio of a downstream side exhaust purification catalyst.

FIG. 5 is a time chart of an air-fuel ratio correction amount AFC and an output air-fuel ratio AFdwn of the downstream side exhaust purification catalyst 24 etc. In the example shown in FIG. 5, at the times $t_0$ to $t_1$, fuel cut control (FC control) is executed. For this reason, the output air-fuel ratio AFup of the upstream side air-fuel ratio sensor 40 and the output air-fuel ratio AFdwn of the downstream side air-fuel ratio sensor 41 become extremely large values. In addition, the oxygen storage amount OSAsc of the upstream side exhaust purification catalyst 20 and oxygen storage amount OSAufc of the downstream side exhaust purification catalyst 24 respectively become the maximum storable amount of oxygen Cmax.

After that, at the times $t_1$ to $t_2$, the oxygen storage amount OSAsc of the upstream side exhaust purification catalyst 20 is reduced as "post-reset rich control". In post-reset rich control, the air-fuel ratio correction amount AFC is set to a post-reset rich correction amount richer in absolute value than the rich set correction amount AFCrich. Due to this, a large amount of unburned gas flows into the upstream side exhaust purification catalyst 20. Along with this, the oxygen storage amount OSAsc of the upstream side exhaust purification catalyst 20 gradually decreases.

After that, if the oxygen storage amount OSAsc of the upstream side exhaust purification catalyst 20 approaches zero, unburned gas starts to flow out from the upstream side exhaust purification catalyst 20. At the time $t_2$, the output air-fuel ratio AFdwn of the downstream side air-fuel ratio sensor 41 reaches the rich judged air-fuel ratio AFrich. In the present embodiment, if, during post-reset rich control, the output air-fuel ratio AFdwn of the downstream side air-fuel ratio sensor 41 becomes the rich judged air-fuel ratio AFrich or less, the air-fuel ratio control explained using FIG. 4 is executed. Therefore, at the time $t_2$, the air-fuel ratio correction amount AFC is switched to the lean set correction amount AFClean.

In the example shown in FIG. 5, at the time $t_2$ on, fuel cut control is not executed. Therefore, due to the above-mentioned air-fuel ratio control, the target air-fuel ratio is repeatedly alternately set to the rich air-fuel ratio and lean air-fuel ratio. For this reason, exhaust gas of basically a substantially stoichiometric air-fuel ratio flows into the downstream side exhaust purification catalyst 24. Periodically, exhaust gas containing a large amount of unburned gas flows in. If, in this way, exhaust gas containing a large amount of unburned gas periodically flows into the downstream side exhaust purification catalyst 24, the oxygen storage amount OSAufc of the downstream side exhaust purification catalyst 24 gradually decreases and the ability to remove unburned gas and $NO_X$ in the downstream side exhaust purification catalyst 24 falls. Below, referring to FIG. 6, the purification ability of the downstream side exhaust purification catalyst 24 will be explained.

Figure 6A:
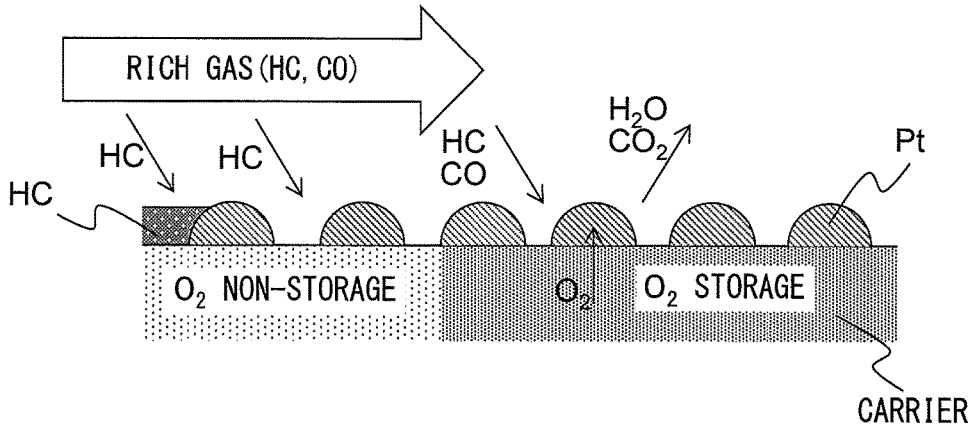
FIG. 6A is a view schematically showing a surface of a carrier of a downstream side exhaust purification catalyst.

FIG. 6 is a view schematically showing the surface of the carrier of the downstream side exhaust purification catalyst 24. In the illustrated example, the carrier of the downstream side exhaust purification catalyst 24 carries platinum (Pt) as a precious metal having a catalytic action. Further, "$O_2$ NON-STORING" in the figure shows the region where oxygen is not stored at the substance having an oxygen storage ability carried at the carrier (below, referred to as "oxygen storing substance"), while "$O_2$ STORING" shows the region where oxygen is being stored at the oxygen storage substance. Further, in the example shown in FIG. 6, exhaust gas flows on the surface of the carrier in the direction shown by the arrow in the figure. Therefore, at the left side of FIG. 6, the upstream side of the downstream side exhaust purification catalyst 24 is shown FIG. 6A shows a state where exhaust gas of a rich air-fuel ratio flows into the downstream side exhaust purification catalyst 24. In the example shown in FIG. 6A, oxygen is released from the oxygen storage substance at only part of the upstream side of the downstream side exhaust purification catalyst 24. Here, the exhaust gas contains unburned HC and CO. For this reason, in the region where the oxygen storage substance stores oxygen, oxygen stored at the oxygen storage substance is released and reacts with the unburned HC and CO on the platinum whereby water and carbon dioxide are produced. As a result, the unburned HC and CO in the exhaust gas is reduced and removed. On the other hand, in the region in which the oxygen storage substance does not store oxygen, oxygen is not released even if unburned HC deposits on the platinum or surface of the carrier. As a result, in the region in which the oxygen storage substance does not store oxygen, the unburned HC is physically adsorbed on the surface of the carrier.

Figure 6B:
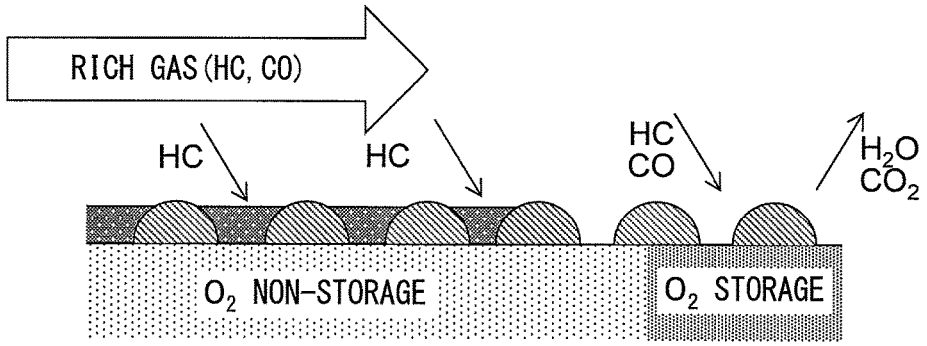
FIG. 6B is a view schematically showing a surface of a carrier of a downstream side exhaust purification catalyst.

On the other hand, if unburned gas continues to flow to the downstream side exhaust purification catalyst 24, the oxygen stored at the oxygen storage substance is successively released. As a result, as shown in FIG. 6B, at most of the parts of the downstream side exhaust purification catalyst 24, the state becomes one where the oxygen storage substance releases oxygen. At only part of the downstream side, the state becomes one where the oxygen storage substance stores oxygen. As a result, as shown in FIG. 6B, if exhaust gas of a rich air-fuel ratio flows into the downstream side exhaust purification catalyst 24, a reaction occurs between the unburned HC and CO in the exhaust gas and the oxygen at only part of the region at the downstream side. On the other hand, at most of the parts of the downstream side exhaust purification catalyst 24, unburned HC is successively physically adsorbed on the platinum or on the surface of the carrier and the physically adsorbed unburned HC covers most of the surface of the platinum.

If unburned HC covers the surface of the platinum, the platinum no longer exhibits a sufficient catalytic action. Therefore, even if unburned gas or $NO_X$ or oxygen is present around the platinum, the reaction speed becomes slower. As a result, in the region where unburned HC covers the surface of the platinum, the ability to remove unburned gas and $NO_X$ falls. Such a phenomenon is called "HC poisoning" of the exhaust purification catalyst. Furthermore, as will be understood from FIG. 6B, the region where HC poisoning occurs increases along with the decrease of the oxygen storage amount OSAufc of the downstream side exhaust purification catalyst 24. Therefore, as shown in FIG. 5, the rate of removal of unburned gas or $NO_X$ in the downstream side exhaust purification catalyst 24 falls along with the decrease of the oxygen storage amount OSAufc if the oxygen storage amount OSAufc of the downstream side exhaust purification catalyst 24 falls by a certain extent or more.

In this regard, the unburned gas or $NO_X$ in the exhaust gas discharged from the engine body is not completely removed at the upstream side exhaust purification catalyst 20 even if the oxygen storage amount OSAsc of the upstream side exhaust purification catalyst 20 is a suitable amount. This situation is shown in FIG. 7.

Figure 7:
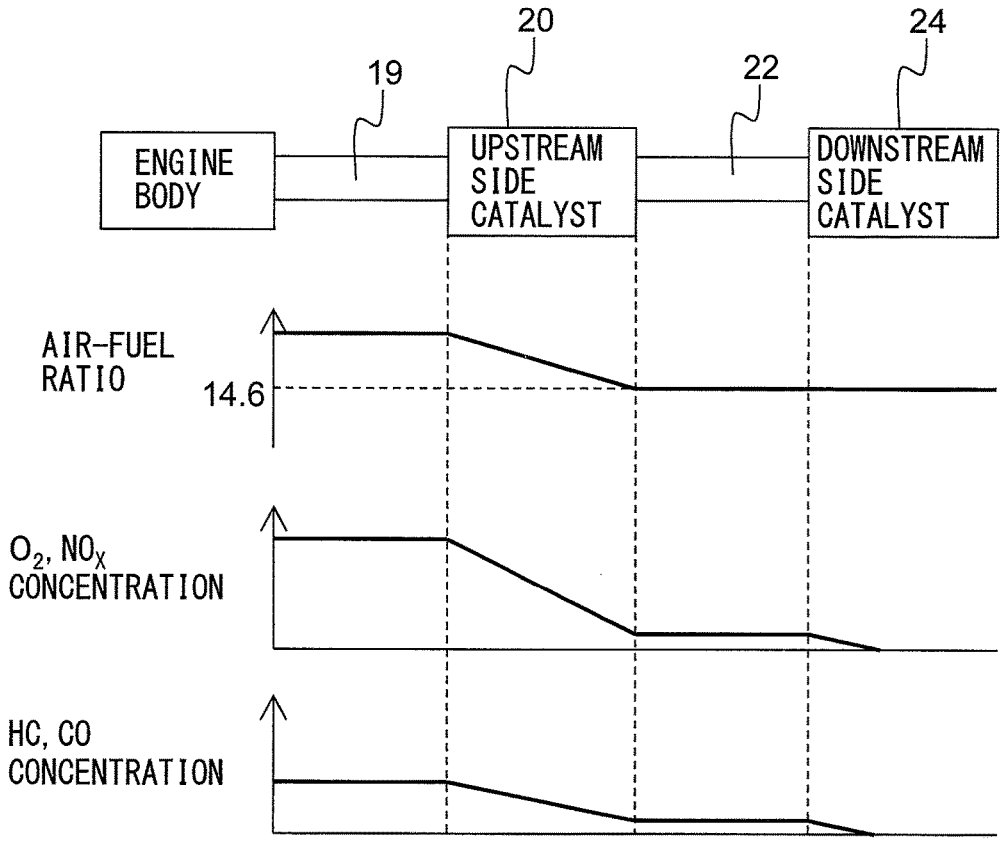
FIG. 7 schematically shows a concentration of oxygen and $NO_X$ in exhaust gas, a concentration of unburned gas, and an air-fuel ratio of different parts in an exhaust passage.

FIG. 7 schematically shows the concentration of oxygen and $NO_X$ in the exhaust gas, the concentration of unburned gas (unburned HC and CO), and the air-fuel ratio at different parts of the exhaust passage. FIG. 7 shows an example where the air-fuel ratio of the exhaust gas discharged from the engine body is a lean air-fuel ratio. As shown in FIG. 7, since the exhaust gas discharged from the engine body is a lean air-fuel ratio, the exhaust gas flowing through the inside of the exhaust manifold 19 contains a larger amount of oxygen and $NO_X$ compared with when the exhaust gas is a stoichiometric air-fuel ratio. In addition, the exhaust gas also contains unburned gas, though not that much.

If such exhaust gas flows into the upstream side exhaust purification catalyst 20, the oxygen in the exhaust gas is stored at the upstream side exhaust purification catalyst 20, and therefore the air-fuel ratio of the exhaust gas becomes the stoichiometric air-fuel ratio. In addition, at the upstream side exhaust purification catalyst 20, the unburned gas and $NO_X$ in the exhaust gas and oxygen react whereby the unburned gas and $NO_X$ are removed. However, at the upstream side exhaust purification catalyst 20, not all of the unburned gas and $NO_X$ in the exhaust gas is necessarily removed. Part flows out from the upstream side exhaust purification catalyst 20.

As a result, as shown in FIG. 7, the air-fuel ratio of the exhaust gas flowing through the inside of the exhaust pipe 22 becomes substantially the stoichiometric air-fuel ratio. This exhaust gas contains a small amount of unburned gas and a small amount of $NO_X$ and oxygen remaining in it. Therefore, exhaust gas of a stoichiometric air-fuel ratio containing unburned gas and $NO_X$ flows into the downstream side exhaust purification catalyst 24.

Here, as explained above, if the HC poisoning of the downstream side exhaust purification catalyst 24 proceeds, the ability of the downstream side exhaust purification catalyst 24 to remove unburned gas or $NO_X$ falls. For this reason, if the exhaust gas flowing into the downstream side exhaust purification catalyst 24 contains a large amount of unburned gas and $NO_X$, sometimes these unburned gas and $NO_X$ cannot necessarily be completely removed. Therefore, as shown in FIG. 6B, if HC poisoning due to unburned HC occurs at the downstream side exhaust purification catalyst 24, it becomes necessary to remove the adsorbed unburned HC so as to restore the purification ability of the downstream side exhaust purification catalyst 24.

<Suppression of HC Poisoning Due to Inflow of $NO_X$>

In this regard, as shown in FIG. 6B, even if unburned HC partially covers the surface of the platinum at the downstream side exhaust purification catalyst 24, if the exhaust gas flowing into the downstream side exhaust purification catalyst 24 contains oxygen or $NO_X$, the unburned HC will react with these oxygen or $NO_X$. As a result, it is possible to remove unburned HC adsorbed at the carrier of the downstream side exhaust purification catalyst 24. This situation is shown in FIG. 8.

Figure 8:
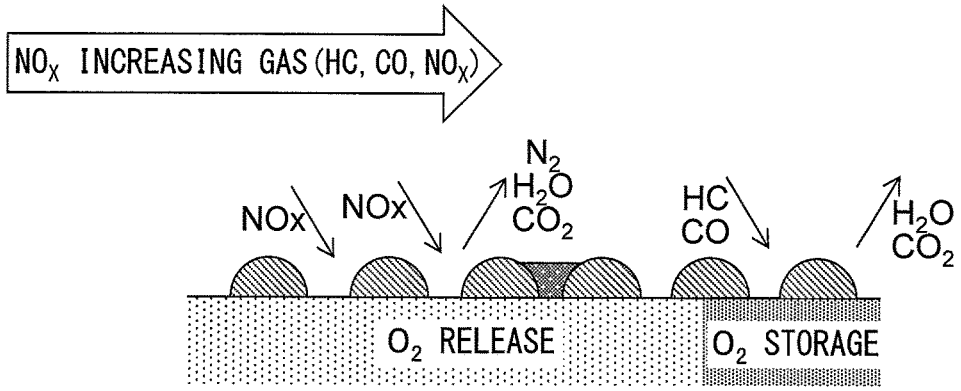
FIG. 8 is a view schematically showing a surface of a carrier of a downstream side exhaust purification catalyst.

FIG. 8 is a view, similar to FIG. 6, schematically showing the surface of the carrier at the downstream side exhaust purification catalyst 24. In particular, in the example shown in FIG. 8, the exhaust gas flowing into the downstream side exhaust purification catalyst 24 contains $NO_X$. If exhaust gas contains $NO_X$ in this way, the $NO_X$ in the exhaust gas reacts with the unburned HC adsorbed on the platinum of the downstream side exhaust purification catalyst 24 and, as a result, unburned HC on the platinum is removed.

However, as explained above, in this example, the purification ability falls, and therefore if the exhaust gas flowing into the downstream side exhaust purification catalyst 24 contains oxygen and $NO_X$ in large amounts, the inflowing $NO_X$ cannot be sufficiently removed. That is, the $NO_X$ in the inflowing exhaust gas ends up flowing out without being removed at the downstream side exhaust purification catalyst 24.

Here, as the method of making exhaust gas containing oxygen or $NO_X$ flow into the downstream side exhaust purification catalyst 24, it may be considered to maintain the air-fuel ratio of the exhaust gas flowing into the upstream side exhaust purification catalyst 20 at the lean air-fuel ratio even if the oxygen storage amount OSAsc of the upstream side exhaust purification catalyst 20 reaches substantially the maximum storable amount of oxygen Cmax. Due to this, the oxygen in the exhaust gas flowing into the upstream side exhaust purification catalyst 20 is not stored in the upstream side exhaust purification catalyst 20 but flows out as is from the upstream side exhaust purification catalyst 20. Along with this, the $NO_X$ in the exhaust gas flowing into the upstream side exhaust purification catalyst 20 also flows out as is from the upstream side exhaust purification catalyst 20. However, with such a method, the exhaust gas flowing into the downstream side exhaust purification catalyst 24 contains a large amount of oxygen and $NO_X$. As a result, the oxygen and $NO_X$ are not sufficiently removed at the downstream side exhaust purification catalyst 24 and flow out from the downstream side exhaust purification catalyst 24. In particular, $NO_X$ is lower in reactivity with unburned HC compared with oxygen, and therefore most of the $NO_X$ is not removed at the downstream side exhaust purification catalyst 24 but flows out from the downstream side exhaust purification catalyst 24.

In this regard, the oxygen contained in the exhaust gas flowing into the upstream side exhaust purification catalyst 20 is removed by the unburned gas contained in the inflowing exhaust gas or is stored in the upstream side exhaust purification catalyst 20. For this reason, so long as the oxygen storage amount OSA of the upstream side exhaust purification catalyst 20 does not reach the vicinity of the maximum storable amount of oxygen, regardless of the air-fuel ratio of the exhaust gas, even if the exhaust gas flowing into the upstream side exhaust purification catalyst 20 contains oxygen, not much oxygen at all will flow out from the upstream side exhaust purification catalyst 20. Therefore, if the oxygen storage amount OSA of the upstream side exhaust purification catalyst 20 does not reach the vicinity of the maximum storable amount of oxygen, even if the air-fuel ratio of the exhaust gas flowing into the upstream side exhaust purification catalyst 20 is made to change somewhat to the lean side, that is, even if making the amount of oxygen flowing into the upstream side exhaust purification catalyst 20 increase, the amount of oxygen contained in the exhaust gas flowing out from the upstream side exhaust purification catalyst 20 does not change much at all.

On the other hand, the $NO_X$ contained in the exhaust gas flowing into the upstream side exhaust purification catalyst 20 is removed by the unburned gas contained in the inflowing exhaust gas. However, $NO_X$ is lower in reactivity with unburned gas compared with oxygen. For this reason, when both oxygen and $NO_X$ are present in the exhaust gas, the unburned gas first reacts with the oxygen. Therefore, $NO_X$ does not completely react at the upstream side exhaust purification catalyst 20, but partially remains. Further, $NO_X$ itself is not stored in the upstream side exhaust purification catalyst 20.

Due to such a property, both when the air-fuel ratio of the exhaust gas flowing into the upstream side exhaust purification catalyst 20 is the lean air-fuel ratio and when it is the rich air-fuel ratio, if the concentration of $NO_X$ in the exhaust gas flowing into the upstream side exhaust purification catalyst 20 becomes higher, the concentration of $NO_X$ in the exhaust gas flowing out from the upstream side exhaust purification catalyst 20 also becomes higher. That is, by making the concentration of $NO_X$ in the exhaust gas flowing into the upstream side exhaust purification catalyst 20 higher, the concentration of $NO_X$ in the exhaust gas flowing into the downstream side exhaust purification catalyst 24 can be raised. Further, such a phenomenon occurs if the oxygen storage amount OSA of the upstream side exhaust purification catalyst 20 is a suitable amount. For this reason, even if the concentration of $NO_X$ in the exhaust gas flowing into the downstream side exhaust purification catalyst 24 becomes high, a large amount of $NO_X$ will never flow into the downstream side exhaust purification catalyst 24 such as when the oxygen storage amount OSA of the upstream side exhaust purification catalyst 20 reaches the vicinity of the maximum storable amount of oxygen Cmax and when oxygen or $NO_X$ cannot be sufficiently removed at the upstream side exhaust purification catalyst 20.

<Control for Increasing $NO_X$>

Therefore, in the present embodiment, after the oxygen storage amount OSAufc of the downstream side exhaust purification catalyst 24 becomes a predetermined limit storage amount smaller than the maximum storable amount of oxygen Cmax or becomes less, the concentration of oxygen in the exhaust gas flowing out from the upstream side exhaust purification catalyst 20 is not allowed to increase, but the concentration of $NO_X$ in the exhaust gas flowing into the upstream side exhaust purification catalyst 20 is made to increase as "control for increasing $NO_X$". This will be explained referring to FIG. 9.

Figure 9:
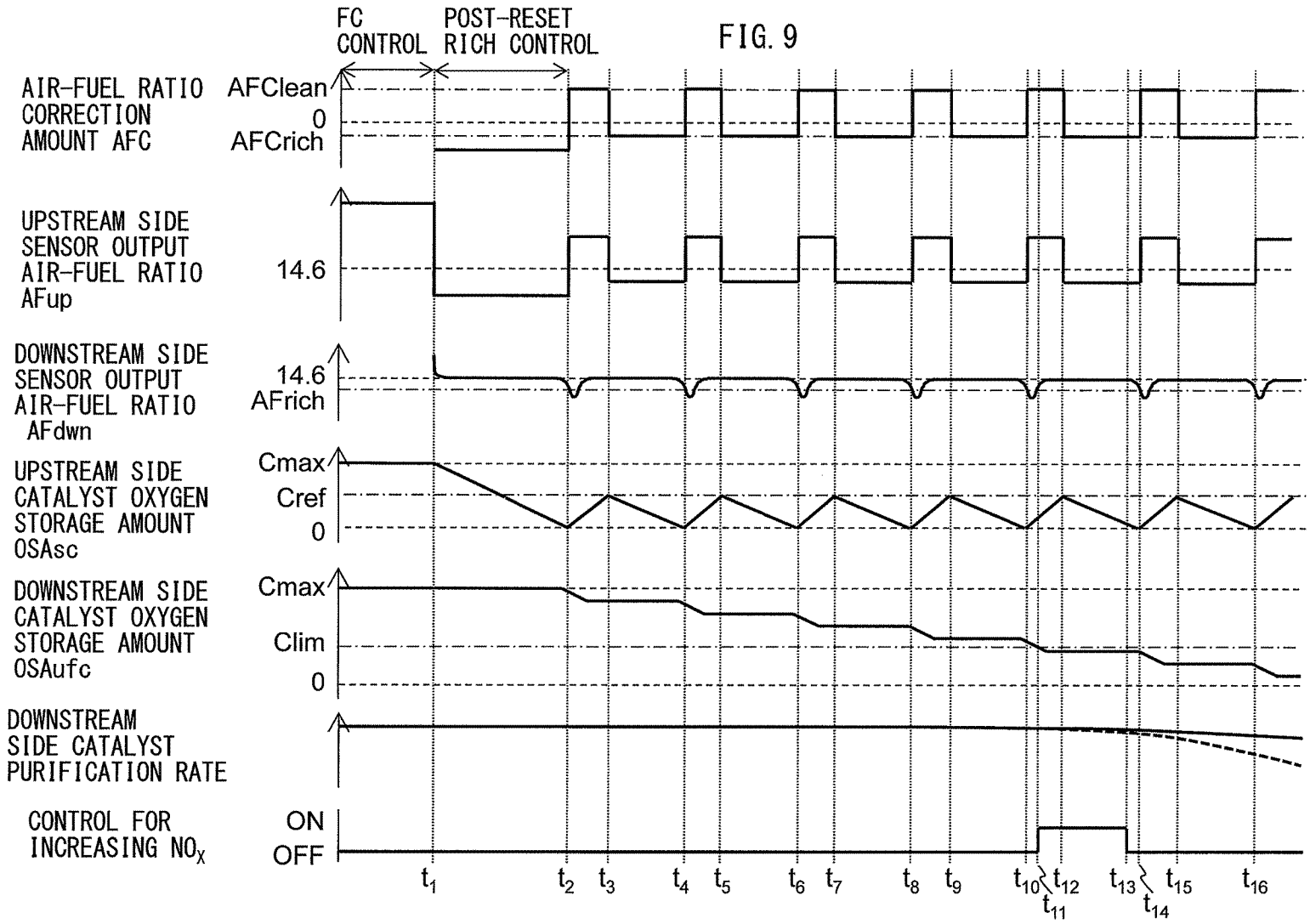
FIG. 9 is a time chart, similar to FIG. 5, of an air-fuel ratio correction amount and presence of $NO_X$ increasing control.

FIG. 9 is a time chart, similar to FIG. 5, of an air-fuel ratio correction amount AFC, presence of control for increasing, for example, $NO_X$. In the example shown in FIG. 9, in the same way as the example shown in FIG. 5, at times $t_0$ to $t_1$, fuel cut control is executed, while at times $t_1$ to $t_2$, post-reset rich control is executed. In addition, at a time $t_2$ on, the air-fuel ratio control such as shown in FIG. 4 is executed.

As explained above, at the time $t_2$ on, due to execution of air-fuel ratio control, the oxygen storage amount OSAsc of the downstream side exhaust purification catalyst 24 gradually decreases. In the example shown in FIG. 9, at a time $t_{10}$, the output air-fuel ratio AFdwn of the downstream side air-fuel ratio sensor 41 becomes the rich judged air-fuel ratio AFrich or less and the air-fuel ratio correction amount AFC is switched from the rich set correction amount AFCrich to the lean set correction amount AFClean. At this time, exhaust gas of a rich air-fuel ratio flows out from the upstream side exhaust purification catalyst 20. Along with this, the oxygen storage amount OSAufc of the downstream side exhaust purification catalyst 24 is decreased. As a result, in the example shown in FIG. 9, at a time $t_{11}$, the oxygen storage amount OSAufc of the downstream side exhaust purification catalyst 24 reaches a limit storage amount Clim.

In the present embodiment, if the oxygen storage amount OSAufc of the downstream side exhaust purification catalyst 24 becomes the limit storage amount Clim or less, the control for increasing $NO_X$ is started. Here, the limit storage amount Clim is made an amount such that the HC poisoning of the downstream side exhaust purification catalyst 24 starts to advance if the above-mentioned air-fuel ratio control is contained after fuel cut control without executing control for increasing $NO_X$. Specifically, the limit storage amount Clim is made a value of ⅔ to 1/10 of the maximum storable amount of oxygen Cmax at the time before use, preferably a value within ½ to ⅐, more preferably a value within ⅓ to ⅕.

Note that, the oxygen storage amount OSAufc of the downstream side exhaust purification catalyst 24, in the same way as the upstream side exhaust purification catalyst 20, is estimated based on a cumulative value ΣOEDufc of the oxygen excess/deficiency in the exhaust gas flowing into the downstream side exhaust purification catalyst 24. Further, an oxygen excess/deficiency OEDufc in the exhaust gas flowing into the downstream side exhaust purification catalyst 24 is calculated by the following formula (2).

$$OEDsc=0.23\times Qi\times(AFdwn-AFS) \quad (2)$$

Here, AFdwn shows the output air-fuel ratio of the downstream side air-fuel ratio sensor 41, while AFS shows the stoichiometric air-fuel ratio.

Due to this, the amount of $NO_X$ flowing into the upstream side exhaust purification catalyst 20 is made to increase. As a result, the amount of $NO_X$ flowing out from the upstream side exhaust purification catalyst 20 also increases. However, as explained later, in control for increasing $NO_X$, the air-fuel ratio of the exhaust gas flowing into the upstream side exhaust purification catalyst 20 does not greatly fluctuate. Therefore, even after control for increasing $NO_X$ is started, the output air-fuel ratio AFup of the upstream side air-fuel ratio sensor 40 does not change that much.

Further, even during control for increasing $NO_X$, the above-mentioned air-fuel ratio control continues to be executed. Therefore, if, at a time $t_{12}$, it is estimated that the oxygen storage amount OSAsc of the upstream side exhaust purification catalyst 20 has reached the switching reference storage amount Cref, that is, if the cumulative oxygen excess/deficiency ΣOEDufc of the exhaust gas flowing into the downstream side exhaust purification catalyst 24 reaches the switching reference value OEDref, the air-fuel ratio correction amount AFC is switched to the lean set air-fuel ratio AFClean.

After that, at a time $t_{13}$ after the elapse of a predetermined reference execution time from the time $t_{11}$, the control for increasing $NO_X$ is made to end. The predetermined reference execution time is set to a time such as one enabling desorption of most of the unburned HC which had been adsorbed when HC poisoning causes unburned HC to be adsorbed on the platinum or carrier at the downstream side exhaust purification catalyst 24. Note that, the timing of end of the control for increasing $NO_X$ does not necessarily have to be judged based on the time of execution of control for increasing $NO_X$. For example, control for increasing $NO_X$ may be ended when the total amount of flow of exhaust gas flowing into the downstream side exhaust purification catalyst 24 from when starting control for increasing $NO_X$ reaches a predetermined reference total amount of flow.

Even after the end of control for increasing $NO_X$, the above-mentioned air-fuel ratio control continues to be executed. Therefore, if at a time $t_{14}$ the output air-fuel ratio AFdwn of the downstream side air-fuel ratio sensor 41 becomes the rich judged air-fuel ratio AFrich or less, the air-fuel ratio correction amount AFC is switched from the lean set correction amount AFClean to the rich set correction amount AFCrich. After that, if, at a time $t_{15}$, it is estimated that the oxygen storage amount OSAsc of the upstream side exhaust purification catalyst 20 has reached the switching reference storage amount Cref, the air-fuel ratio correction amount AFC is switched to the lean set air-fuel ratio AFClean.

<Effect of Control for Increasing $NO_X$>

As will be understood from FIG. 9, in the present embodiment, if the oxygen storage amount OSAufc of the downstream side exhaust purification catalyst 24 becomes the limit storage amount Clim or less, that is, if HC poisoning of the downstream side exhaust purification catalyst 24 starts to advance, control for increasing $NO_X$ is started. If control for increasing $NO_X$ is started, the concentration of $NO_X$ in the exhaust gas flowing into the upstream side exhaust purification catalyst 20 increases. Here, as explained above, if the concentration of $NO_X$ in the exhaust gas flowing into the upstream side exhaust purification catalyst 20 increases, the concentration of $NO_X$ in the exhaust gas flowing out from the upstream side exhaust purification catalyst 20 increases. Therefore, the concentration of $NO_X$ in the exhaust gas flowing into the downstream side exhaust purification catalyst 24 is made to increase. If the concentration of $NO_X$ in the exhaust gas flowing into the downstream side exhaust purification catalyst 24 in this way is made to increase, in the downstream side exhaust purification catalyst 24, the $NO_X$ reacts not only with the unburned gas in the exhaust gas but also the unburned HC adsorbed on the platinum or carrier. As a result, it is possible to remove the unburned HC adsorbed on the platinum or carrier of the downstream side exhaust purification catalyst 24 and possible to suppress HC poisoning of the downstream side exhaust purification catalyst 24. Therefore, as shown in FIG. 9 by the solid line, it is possible to suppress a fall in the rate of removal of unburned gas or $NO_X$ of the downstream side exhaust purification catalyst 24 (note that, in the figure, the broken line shows the trend in the rate of removal where no control for increasing $NO_X$ is executed).

Further, even during execution of control for increasing $NO_X$, the above-mentioned air-fuel ratio control continues to be maintained. For this reason, the oxygen storage amount OSAsc of the upstream side exhaust purification catalyst 20 never reaches the vicinity of the maximum storable amount of oxygen Cmax. Therefore, the oxygen storage ability of the upstream side exhaust purification catalyst 20 is maintained and exhaust gas of a lean air-fuel ratio will not flow out from the upstream side exhaust purification catalyst 20. That is, the ability of the upstream side exhaust purification catalyst 20 to remove $NO_X$ is maintained as it is. Further, during execution of control for increasing $NO_X$, the concentration of $NO_X$ in the exhaust gas flowing out from the upstream side exhaust purification catalyst 20 increases, but does not increase that much. Therefore, during execution of control for increasing $NO_X$, a large amount of $NO_X$ unable to be removed by the downstream side exhaust purification catalyst 24 will never flow into the downstream side exhaust purification catalyst 24. For this reason, it is possible to maintain the ability of the exhaust purification system to remove $NO_X$.

Note that, in the above embodiment, after fuel cut control, if the oxygen storage amount OSAufc of the downstream side exhaust purification catalyst 24 becomes the limit storage amount or less, the control for increasing $NO_X$ is executed only once. However, even if executing the control for increasing $NO_X$ once to remove the unburned HC adsorbed at the downstream side exhaust purification catalyst 24, after that, again the unburned HC starts to be adsorbed at the downstream side exhaust purification catalyst 24. Therefore, the control for increasing $NO_X$ is preferably executed several times until fuel cut control is again executed.

In executing this control for increasing $NO_X$ several times, a second cycle of the control for increasing $NO_X$ is executed after the oxygen storage amount OSAufc of the downstream side exhaust purification catalyst 24 becomes a second limit storage amount smaller than the limit storage amount (below, referred to as "the first limit storage amount") or becomes less. Further, a third cycle of the control for increasing $NO_X$ is executed after the oxygen storage amount OSAufc of the downstream side exhaust purification catalyst 24 becomes a third limit storage amount smaller than the second limit storage amount or becomes less. In this way, in executing the control for increasing $NO_X$ several times, it is executed after the oxygen storage amount OSAufc of the downstream side exhaust purification catalyst 24 reaches a limit storage amount smaller than the previous limit storage amount. Further, the difference of the first limit storage amount and the second limit storage amount and the difference of the second limit storage amount and the third limit storage amount are set so as to become smaller than the difference between the maximum storable amount of oxygen and the first limit storage amount.

<Specific Example of Control for Increasing $NO_X$>

Figure 10:
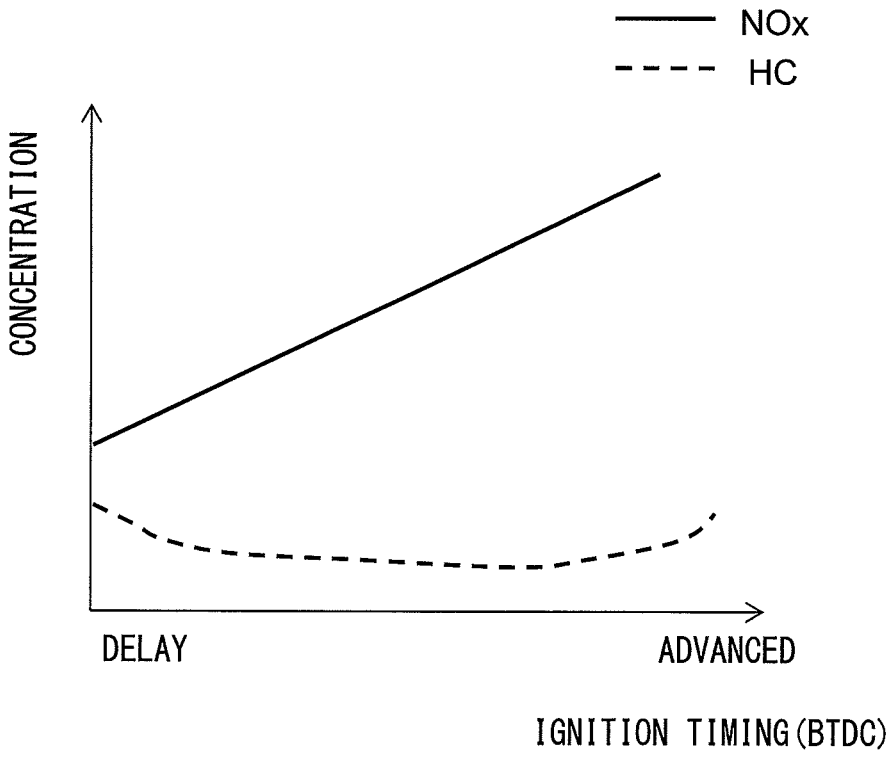
FIG. 10 is a view showing a relationship between an ignition timing and a concentration of $NO_X$ and HC flowing out from an engine body.

Next, a specific example of control for increasing $NO_X$ will be explained. As one example of control for increasing $NO_X$, advancing the timing of ignition of the air-fuel mixture by the spark plug 10 may be mentioned. FIG. 10 is a view showing the relationship between the timing of ignition by the spark plug 10 and the concentration of $NO_X$ and HC flowing out from the engine body. As will be understood from FIG. 10, even if changing the ignition timing, the concentration of unburned HC in the exhaust gas flowing out from the engine body does not change that much. As opposed to this, if making the ignition timing advance, the concentration of $NO_X$ in the exhaust gas flowing out from the engine body becomes higher. This is because the more advanced the ignition timing, the more the combustion temperature of the air-fuel mixture in the combustion chamber 5 rises and thereby the more the amount of $NO_X$ in the exhaust gas increases.

Further, even if changing the ignition timing in this way, the amounts of fuel injection from the fuel injectors 11, 12 are not changed, and therefore the air-fuel ratio of the air-fuel mixture in the combustion chamber 5 does not change. Therefore, the concentration of oxygen in the exhaust gas flowing out from the engine body basically does not change. Therefore, by making the ignition timing advance, the concentration of oxygen in the exhaust gas flowing into the upstream side exhaust purification catalyst 20 does not increase. Only the concentration of $NO_X$ is increased.

Due to the above, in the first cycle of the control for increasing $NO_X$, the timing of ignition of the air-fuel ratio by the spark plug 10 is advanced compared to when not executing the control for increasing $NO_X$. Due to this, it is possible to make only the concentration of $NO_X$ in the exhaust gas flowing into the upstream side exhaust purification catalyst 20 increase without making the concentration of oxygen increase.

Further, as another example of the control for increasing $NO_X$, it may be considered to decrease the amount of EGR. As shown in FIG. 1, the internal combustion engine of the present embodiment is provided with an EGR mechanism having an EGR gas conduit 26 and an EGR control valve 27. This EGR mechanism is used to feed part of the exhaust gas discharged from a combustion chamber 5 of the internal combustion engine again to the combustion chamber 5. In such an EGR mechanism, the concentration of $NO_X$ and HC flowing out from the engine body according to the amount of exhaust gas fed by the EGR mechanism to a combustion chamber 5 (amount of EGR) changes.

Figure 11:
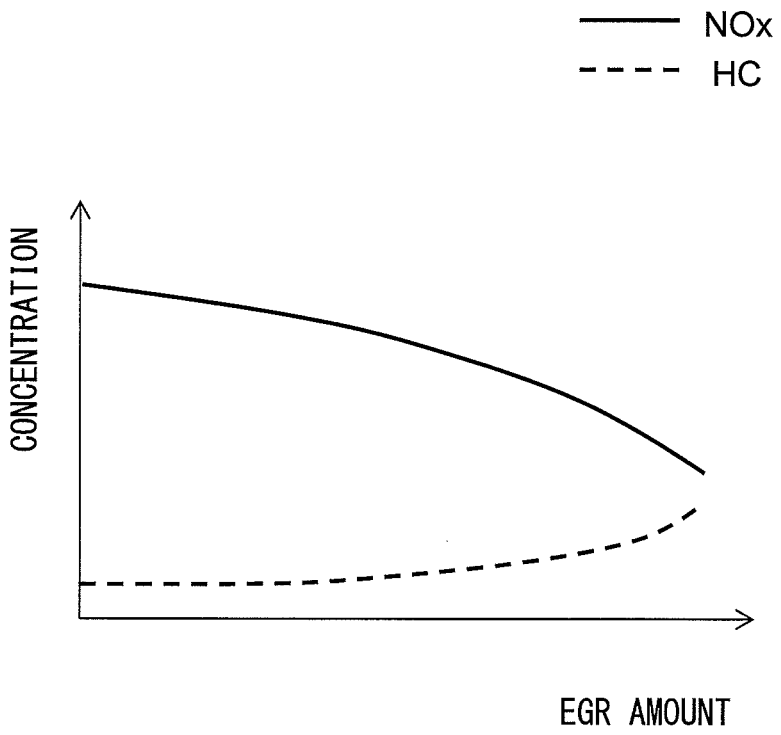
FIG. 11 is a view showing a relationship between an EGR amount and a concentration of $NO_X$ and HC flowing out from an engine body.

FIG. 11 is a view showing the relationship between the amount of EGR and the concentration of $NO_X$ and HC flowing out from the engine body. As will be understood from FIG. 11, if making the amount of EGR decrease, along with this, the concentration of unburned HC decreases or the concentration of $NO_X$ increases. This is because by the amount of EGR decreasing, the combustion temperature of the air-fuel mixture in the combustion chamber 5 rises and thereby the amount of $NO_X$ in the exhaust gas increases.

Further, even if changing the amount of EGR in this way, the ratio of air and fuel flowing into a combustion chamber 5 will not change, therefore the air-fuel ratio of the air-fuel mixture in the combustion chamber 5 will not change. Therefore, the concentration of oxygen in the exhaust gas flowing out from the engine body basically does not change. For this reason, by decreasing the amount of EGR, only the concentration of $NO_X$ in the exhaust gas flowing into the upstream side exhaust purification catalyst 20 increases without the concentration of oxygen being increased.

Due to the above, in the second cycle of control for increasing $NO_X$, the amount of EGR is made to decrease compared with when not executing the control for increasing $NO_X$. Due to this, it is possible to make only the concentration of $NO_X$ in the exhaust gas flowing into the upstream side exhaust purification catalyst 20 increase without making the concentration of oxygen increase.

As still another example of the control for increasing $NO_X$, it may be considered to adjust the ratio of the amounts of fuel injection from the cylinder fuel injector 11 and the port fuel injector 12. Here, as shown in FIG. 1, the internal combustion engine of the present embodiment has, for each cylinder, a cylinder fuel injector 11 injecting and feeding fuel directly into a combustion chamber 5 and a port fuel injector 12 injecting and feeding fuel into an intake passage of the intake port 7. In such an internal combustion engine, the concentration of $NO_X$ and HC flowing out from the engine body changes in accordance with the ratio of feed of fuel of the cylinder fuel injector 11 and the port fuel injector 12.

Figure 12:
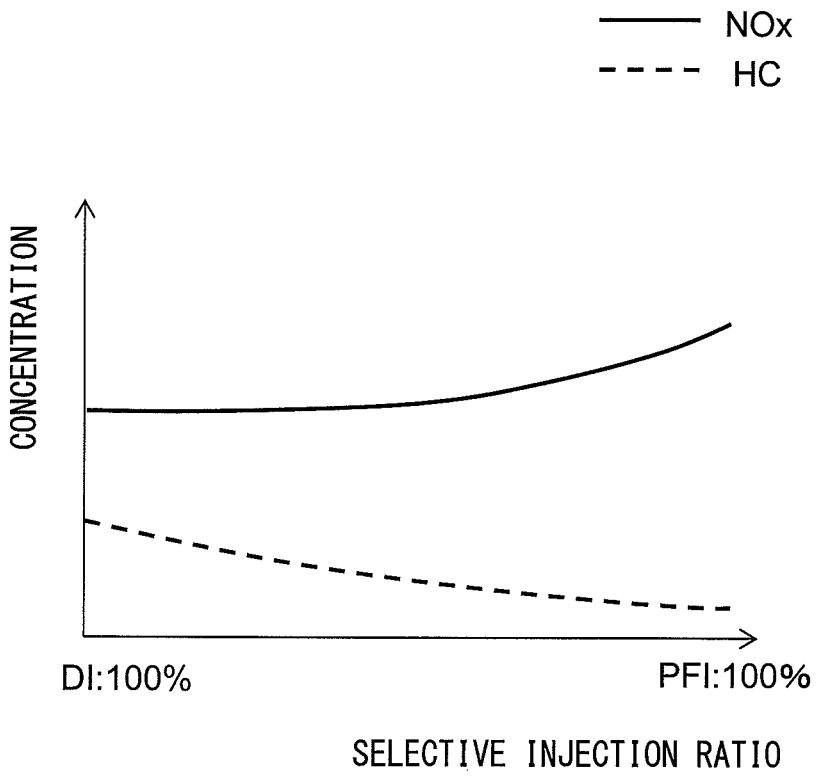
FIG. 12 is a view showing a relationship between a selective injection rate of a cylinder fuel injector and port fuel injector and a concentration of $NO_X$ and HC flowing out from an engine body.

FIG. 12 is a view showing the relationship between the ratio of feed of fuel of the cylinder fuel injector 11 and the port fuel injector 12 (selective injection ratio) and the concentration of $NO_X$ and HC flowing out from the engine body. As will be understood from FIG. 12, if increasing the ratio of feed of fuel from the port fuel injector 12 from the state of injecting fuel from only the cylinder fuel injector 11 (in figure, DI: 100%), the concentration of unburned HC decreases and the concentration of $NO_X$ increases along with this. The reason why the concentration of $NO_X$ increases in this way is as follows: That is, if injecting fuel from the port fuel injector 12, the fuel and air are sufficiently mixed from injection of fuel until ignition. For this reason, in the combustion chamber 5, the air-fuel mixture is burned well. As a result, the combustion temperature of the air-fuel mixture rises. If the combustion temperature of the air-fuel mixture rises in this way, the amount of $NO_X$ in the exhaust gas increases along with this.

Further, even if changing the selective injection ratio in this way, the ratio of air and fuel fed into a combustion chamber 5 up until the time of combustion does not change, and therefore the air-fuel ratio of the air-fuel mixture in the combustion chamber 5 does not change. Therefore, the concentration of oxygen in exhaust gas flowing out from the engine body basically does not change. For this reason, the ratio of the amount of fuel injection from the port fuel injector 12 to the amount of fuel injection from the cylinder fuel injector 11, defined as an "intake passage injection ratio", is made to increase to thereby make only the concentration of $NO_X$ increase without making the concentration of oxygen in the exhaust gas flowing into the upstream side exhaust purification catalyst 20 increase.

From the above, in the third cycle of the control for increasing $NO_X$, compared with not executing the control for increasing $NO_X$, the intake passage injection ratio is made to increase. Due to this, it is possible to make only the concentration of $NO_X$ in the exhaust gas flowing into the upstream side exhaust purification catalyst 20 increase without making the concentration of oxygen increase.

<Condition for Execution of Control Increasing $NO_X$>

In this regard, as explained above, if unburned HC is adsorbed on the downstream side exhaust purification catalyst 24, if exhaust gas containing $NO_X$ flows into the downstream side exhaust purification catalyst 24, the unburned HC and $NO_X$ will react and the unburned HC will be removed. Such a reaction between the unburned HC and $NO_X$ does not sufficiently occur if the temperature of the downstream side exhaust purification catalyst 24 is low. Therefore, from this viewpoint, in order for the above-mentioned control for increasing $NO_X$ to be executed, the temperature of the downstream side exhaust purification catalyst 24 has to be a certain degree of a high temperature. Conversely, when the temperature of the downstream side exhaust purification catalyst 24 is low, if control for increasing $NO_X$ is executed, there is a possibility that the $NO_X$ in the exhaust gas flowing into the downstream side exhaust purification catalyst 24 will end up flowing out as is without being removed at the downstream side exhaust purification catalyst 24.

Therefore, in the present embodiment, a temperature sensor (not shown) which detects the temperature of the downstream side exhaust purification catalyst 24 is used to detect the temperature of the downstream side exhaust purification catalyst 24. Further, if the temperature of the downstream side exhaust purification catalyst 24 is less than a predetermined lower limit temperature, even if the oxygen storage amount OSAufc of the downstream side exhaust purification catalyst 24 becomes the limit storage amount Clim or less, control for increasing NOX is not executed. Here, the lower limit temperature is a temperature where the unburned HC adsorbed at the downstream side exhaust purification catalyst 24 and the NOX in the exhaust gas will not sufficiently react if the temperature of the downstream side exhaust purification catalyst 24 falls any further, for example, is 500° C.

In this way, the temperature of the downstream side exhaust purification catalyst 24 is low, so control for increasing $NO_X$ is not executed, and therefore it is possible to keep the $NO_X$ flowing into the downstream side exhaust purification catalyst 24 from ending up flowing out as is without being removed at the downstream side exhaust purification catalyst 24.

Note that, if the oxygen storage amount OSAufc of the downstream side exhaust purification catalyst 24 becomes the limit storage amount Clim or less, if the temperature of the downstream side exhaust purification catalyst 24 is less than the lower limit temperature, the temperature of the downstream side exhaust purification catalyst 24 may also be raised as "temperature raising control". As a temperature raising control, for example, it may be considered to make the combustion air-fuel ratio the rich air-fuel ratio at part of the cylinders among the plurality of cylinders and make the combustion air-fuel ratio the lean air-fuel ratio at the remaining cylinders as "dither control".

Further, as explained above, during the control for increasing $NO_X$, the exhaust gas flowing into the downstream side exhaust purification catalyst 24 contains $NO_X$, but the concentration is basically not that high. However, for example, at a time of engine high load operation or a time of engine high speed operation, the amount of flow of exhaust gas discharged from the engine body becomes great and therefore the amount of flow of the exhaust gas flowing into the downstream side exhaust purification catalyst 24 becomes greater. If, in this way, the amount of flow of the exhaust gas flowing into the downstream side exhaust purification catalyst 24 becomes greater, even if the concentration of $NO_X$ in the exhaust gas is not that high, the amount of $NO_X$ flowing into the downstream side exhaust purification catalyst 24 per unit time increases. In this way, if a large amount of $NO_X$ flows into the downstream side exhaust purification catalyst 24 per unit time, part of the inflowing $NO_X$ will not react with the unburned HC adsorbed on the downstream side exhaust purification catalyst 24 but will end up flowing out from the downstream side exhaust purification catalyst 24.

Therefore, in the present embodiment, if the amount of flow of exhaust gas discharged from the engine body is a predetermined upper limit flow or more, even if the oxygen storage amount OSAufc of the downstream side exhaust purification catalyst 24 is the limit storage amount Clim or less, control for increasing $NO_X$ is not executed. Here, the upper limit flow is the amount of flow whereby if the amount of flow of exhaust gas flowing into the downstream side exhaust purification catalyst 24 becomes that extent or more, even if unburned HC is adsorbed on the downstream side exhaust purification catalyst 24, the $NO_X$ in the inflowing exhaust gas is no longer sufficiently removed, for example, is 10 g/s. Further, the amount of flow of exhaust gas discharged from the engine body is calculated or estimated based on the amount of flow of air detected by the air flow meter 39. The amount of flow of intake air detected by the air flow meter 39 may be used as is as the amount of flow of exhaust gas discharged from the engine body.

<Flow Chart of Processing for Setting Air-Fuel Ratio Correction Amount>

Figure 13:
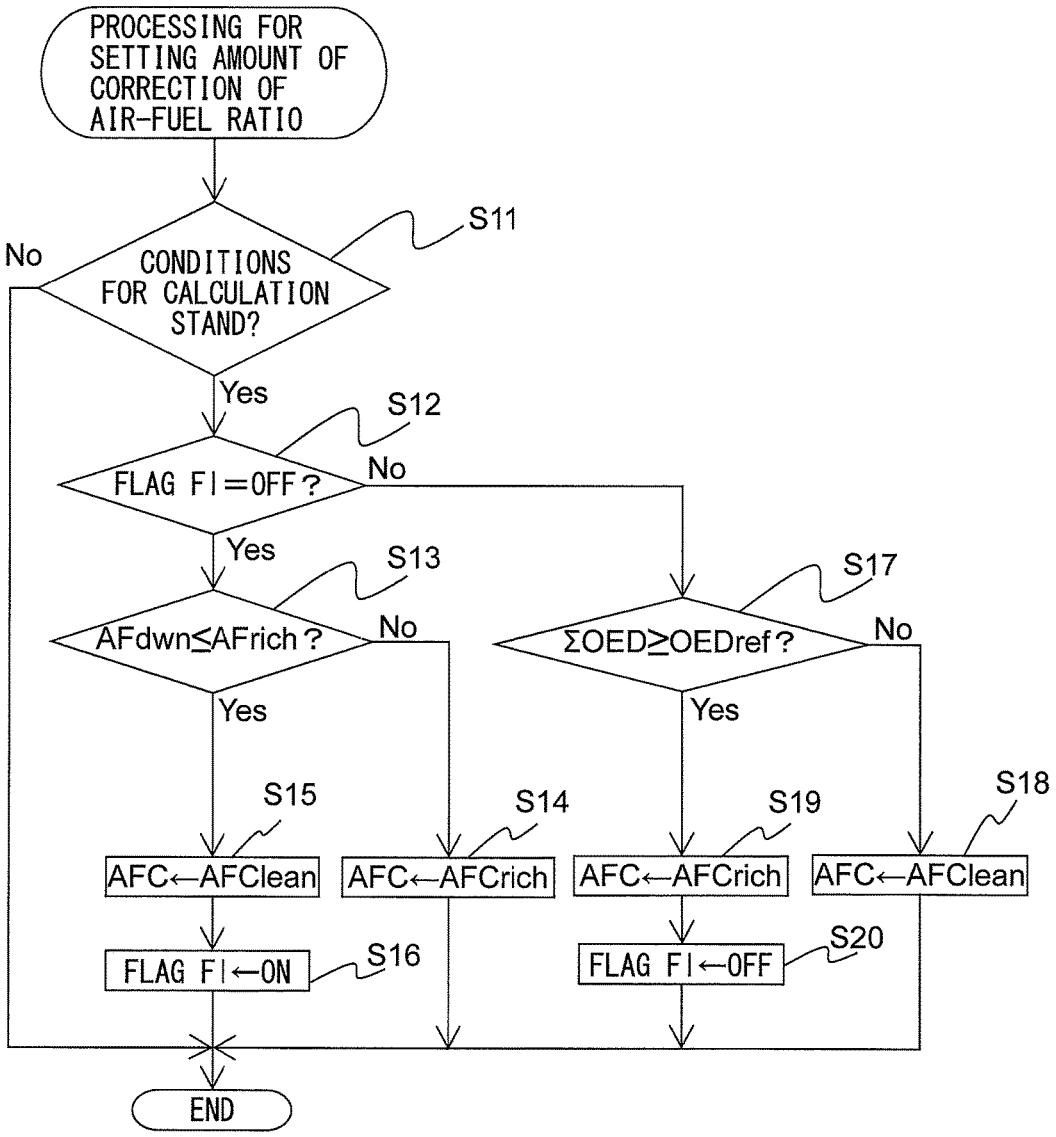
FIG. 13 is a flow chart showing a control routine of control for setting a correction amount of an air-fuel ratio.

FIG. 13 is a flow chart showing a control routine for control for setting the air-fuel ratio correction amount. The illustrated control routine is performed by interruption at certain time intervals.

As shown in FIG. 13, first, at step S11, it is judged if the condition for calculation of the air-fuel ratio correction amount AFC stands. Similar to where a condition for calculation of the air-fuel ratio correction amount AFC stands, being in the middle of normal control where feedback control is performed and, for example, not being in the middle of fuel cut control may be mentioned. If at step S11 it is judged that the condition for calculation of the target air-fuel ratio stands, the routine proceeds to step S12.

At step S12, it is judged if a lean set flag Fl is set OFF. The lean set flag Fl is set ON when the air-fuel ratio correction amount AFC is set to the lean set correction amount AFClean and is set OFF in other cases. If at step S12 the lean set flag Fl is set OFF, the routine proceeds to step S13. At step S13, it is judged if the output air-fuel ratio AFdwn of the downstream side air-fuel ratio sensor 41 is the rich judged air-fuel ratio AFrich or less. If it is judged that the output air-fuel ratio AFdwn of the downstream side air-fuel ratio sensor 41 is larger than the rich judged air-fuel ratio AFrich, the routine proceeds to step S14. At step S14, the air-fuel ratio correction amount AFC is maintained as set to the rich set correction amount AFCrich, and the control routine is made to end.

On the other hand, if the oxygen storage amount OSA of the upstream side exhaust purification catalyst 20 is decreased and the air-fuel ratio of the exhaust gas flowing out from the upstream side exhaust purification catalyst 20 falls, at step S13, it is judged that the output air-fuel ratio AFdwn of the downstream side air-fuel ratio sensor 41 is the rich judged air-fuel ratio AFrich or less. Then, the routine proceeds to step S15, where the air-fuel ratio correction amount AFC is switched to the lean set correction amount AFClean. Next, at step S16, the lean set flag Fl is set ON, then the control routine is made to end.

If the lean set flag Fl is set ON, at the next control routine, at step S12, it is judged that the lean set flag Fl is not set OFF, then the routine proceeds to step S17. At step S17, it is judged if a cumulative oxygen excess/deficiency ΣOED from when the air-fuel ratio correction amount AFC was switched to the lean set correction amount AFClean is smaller than the switching reference value OEDref. If it is judged that the cumulative oxygen excess/deficiency ΣOED is smaller than the switching reference value OEDref, the routine proceeds to step S18, where the air-fuel ratio correction amount AFC continues to be maintained as set to the lean set correction amount AFClean, then the control routine is made to end. On the other hand, if the oxygen storage amount of the upstream side exhaust purification catalyst 20 increases, finally, at step S17, it is judged that the cumulative oxygen excess/deficiency ΣOED is the switching reference value OEDref or more, then the routine proceeds to step S19. At step S19, the air-fuel ratio correction amount AFC is switched to the rich set correction amount AFCrich. Next, at step S20, the lean set flag Fl is reset OFF, then the control routine is made to end.

<Flow Chart of Processing for Executing Increasing Control>

Figure 14:
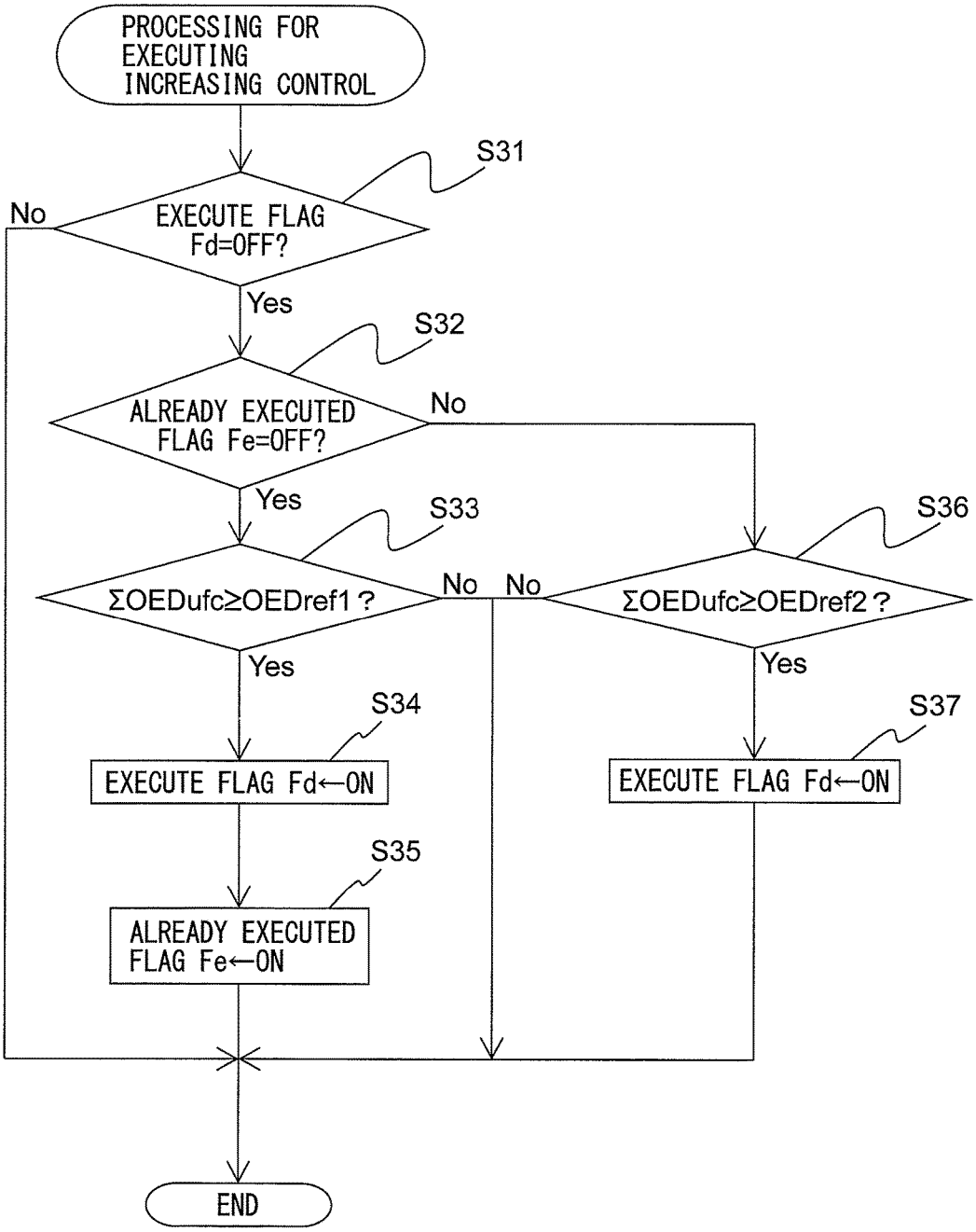
FIG. 14 is a flow chart showing a control routine of processing for executing increasing control which judges the start of execution of $NO_X$ increasing control.

FIG. 14 is a flow chart showing a control routine of processing for executing increasing control judging the start of execution of control for increasing $NO_X$. The illustrated control routine is executed by interruption every certain time interval.

First, at step S31, it is judged if an execute flag Fd of the control for increasing $NO_X$ has become OFF. The execute flag Fd is a flag which is set ON if the control for increasing $NO_X$ is executed and is set OFF if it is not executed. If control for increasing $NO_X$ is not being executed and therefore the execute flag Fd is OFF, the routine proceeds to step S32. At step S32, it is judged if an already executed flag Fe has become ON. The already executed flag Fe is a flag which is set ON if control for increasing $NO_X$ is already being executed after fuel cut control was previously executed and is set OFF if control increasing $NO_X$ is still not being executed. Note that, the already executed flag Fe is reset to OFF if fuel cut control is executed.

If at step S32 it is judged that the already executed flag Fe is OFF, that is, if control for increasing $NO_X$ is still not executed after the previous fuel cut control, the routine proceeds to step S33. At step S33, it is judged that a cumulative oxygen excess/deficiency ΣOEDufc of the downstream side exhaust purification catalyst 24 after the end of fuel cut control has become a first reference value OEDref1 or more. That is, it can be said that at step S33 it is judged if the oxygen storage amount OSAufc of the downstream side exhaust purification catalyst 24 has become the limit storage amount Clim or less. If at step S33 it is judged that the cumulative oxygen excess/deficiency ΣOEDufc of the downstream side exhaust purification catalyst 24 is smaller than a first reference value OEDref1, the oxygen storage amount OSAref1 of the downstream side exhaust purification catalyst 24 does not fall that much. Therefore, the HC poisoning of the downstream side exhaust purification catalyst 24 also does not advance. Therefore, control for increasing $NO_X$ is not executed and the control routine is made to end. On the other hand, if at step S33 it is judged that the cumulative oxygen excess/deficiency ΣOEDufc to the downstream side exhaust purification catalyst 24 is the first reference value OEDref1 or more, the routine proceeds to step S34. At step S34, the execute flag Fd is set to ON. As a result, due to the processing for increasing $NO_X$ shown in FIG. 15, control for increasing $NO_X$ is started. Next, at step S35, the already executed flag Fe is set to ON, then the control routine is made to end.

After this, in the control routine after the processing for increasing $NO_X$ ends, the already executed flag Fe is set to ON, and therefore the routine proceeds from step S32 to step S36. At step S36, after the end of the previous processing for increasing $NO_X$, it is judged if the cumulative oxygen excess/deficiency ΣOEDufc to the downstream side exhaust purification catalyst 24 has become a second reference value OEDref2 or more. That is, at step S36, it can be said to be judged if the oxygen storage amount OSAufc of the downstream side exhaust purification catalyst 24 is the second limit storage amount or the third limit storage amount or less. Note that, the second reference value OEDref2 is a value smaller than the first reference value OEDref1 and is a value equal to the difference between the above-mentioned first limit storage amount and second limit storage amount.

If at step S36 the cumulative oxygen excess/deficiency ΣOEDufc at the downstream side exhaust purification catalyst 24 is smaller than the second reference value OEDref2, HC poisoning of the downstream side exhaust purification catalyst 24 does not advance. Therefore, the control for increasing $NO_X$ is not executed and the control routine is made to end. On the other hand, if at step S36 it is judged that the cumulative oxygen excess/deficiency ΣOEDufc at the downstream side exhaust purification catalyst 24 is the second reference value OEDref2 or more, the routine proceeds to step S37. At step S37, the execute flag Fd is turned ON and, as a result, control for increasing $NO_X$ is started by the processing for increasing $NO_X$ shown in FIG. 15.

<Flow Chart of Processing for Increasing $NO_X$>

Figure 15:
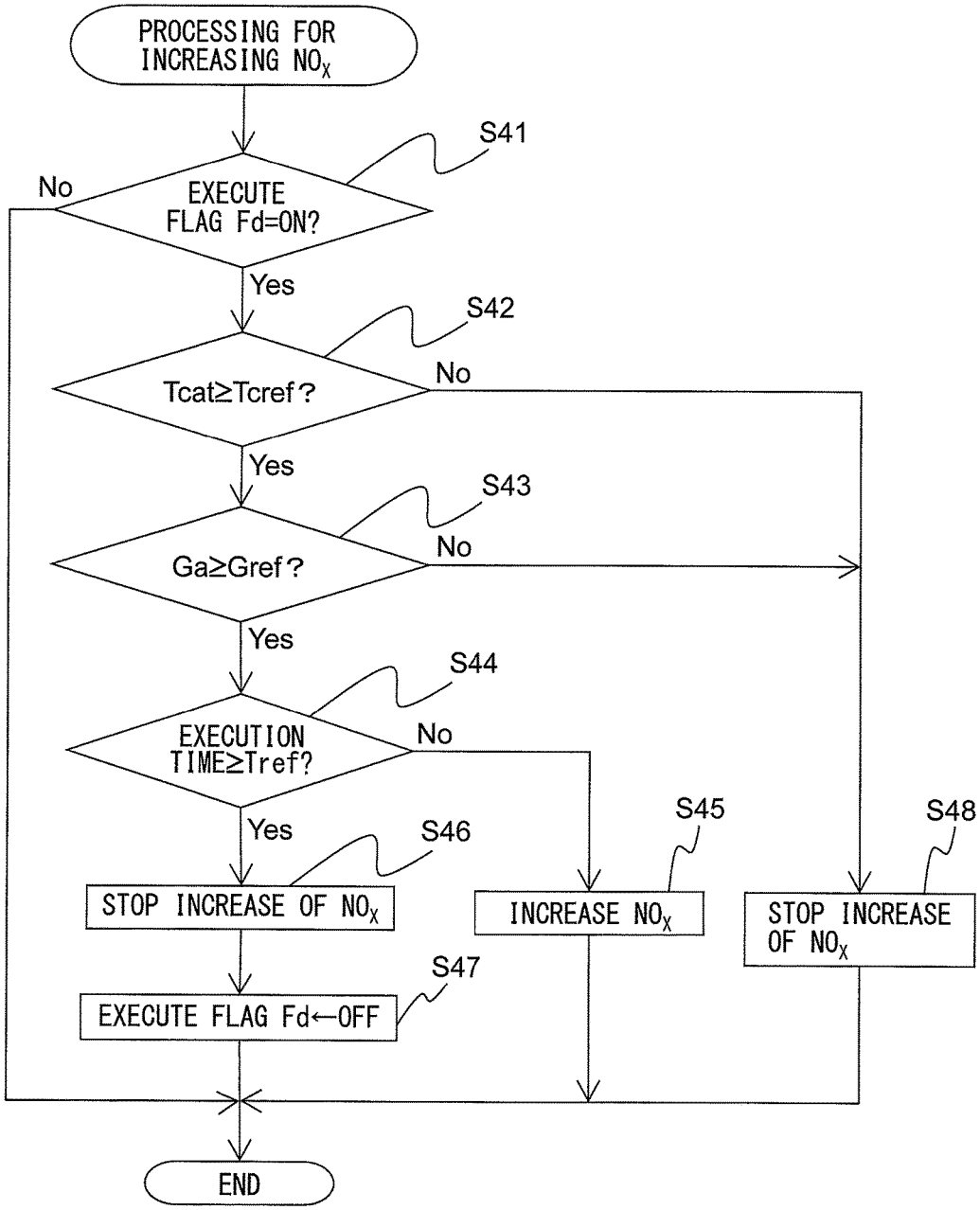
FIG. 15 is a flow chart showing a control routine of processing for increasing $NO_X$.

FIG. 15 is a flow chart showing a control routine of processing for increasing $NO_X$. The illustrated control routine is executed by interruption every certain time interval.

First, at step S41, it is judged of a flag Fd for executing control for increasing $NO_X$ is ON. If it is judged the execute flag Fd is OFF, the control routine is made to end. On the other hand, if the execute flag Fd is set ON at steps S34 and S37 of FIG. 14, it is judged at step S41 that the execute flag Fd becomes ON and the routine proceeds to step S42. At step S42, an output of the temperature sensor detecting the temperature of the downstream side exhaust purification catalyst 24 is used as a basis to judge if a temperature Tcat of the downstream side exhaust purification catalyst 24 is a lower limit temperature Tcref or more. If at step S42 it is judged that the temperature Tcat of the downstream side exhaust purification catalyst 24 is the lower limit temperature Tcref or more, the routine proceeds to step S43. At step S43, it is judged if an intake air amount Ga which is detected by the air flow meter 39 is an upper limit flow amount Gref or more. If at step S43 it is judged that the intake air amount Ga is the upper limit flow amount Gref or more, the routine proceeds to step S44.

At step S44, it is judged if a time T for execution of control for increasing $NO_X$, that is, the elapsed time T from when the execute flag FD is turned ON (minus time during which control for increasing $NO_X$ is stopped) is the reference time Tref or more. If not much time has elapsed from when control for increasing $NO_X$ is started, it is judged that the execution time T is shorter than the reference time Tref and the routine proceeds to step S45. At step S45, control for increasing $NO_X$ is executed. Therefore, for example, compared with not executing control for increasing $NO_X$, the timing of ignition by the spark plug 10 is made to advance. After that, the control routine is made to end.

On the other hand, if at step S42 it is judged that the temperature Tcat of the downstream side exhaust purification catalyst 24 is less than the lower limit temperature Tcref, if executing control for increasing $NO_X$, there is a possibility of $NO_X$ flowing out from the downstream side exhaust purification catalyst 24, and therefore the routine proceeds from step S42 to step S48. Further, even if at step S43 it is judged that the intake air amount Ga is less than the upper limit flow amount Gref, if executing control for increasing $NO_X$, there is a possibility of $NO_X$ flowing out from the downstream side exhaust purification catalyst 24, and therefore the routine proceeds from step S43 to step S48. At step S48, the control for increasing $NO_X$ is stopped. Therefore, for example, compared with executing control for increasing $NO_X$, the timing of ignition by the spark plug 10 is delayed. After that, the control routine is made to end. After that, if the time for execution of control for increasing $NO_X$ becomes longer, at the next control routine, it is judged at step S44 that the time T for execution of control for increasing $NO_X$ is the reference time Tref or more, then the routine proceeds to step S46. At step S46, the control for increasing $NO_X$ is made to end. Next, at step S47, the execute flag Fd is reset to OFF, then the control routine is made to end.

Although this invention has been described by way of the specific embodiments, this invention is not limited to the above embodiments. It is possible for a person skilled in the art to modify or alter the above embodiments in various manners within the technical scope of the present invention.

This application claims priority based on Japanese Patent Application No. 2015-135217 filed with the Japan Patent Office on Jul. 6, 2015, the entire contents of which are incorporated into the present specification by reference.

The invention claimed is:

1. An exhaust purification system of an internal combustion engine comprising:

an upstream side catalyst provided in an exhaust passage of the internal combustion engine;

a downstream side catalyst provided at a downstream side from the upstream side catalyst in a direction of exhaust flow in the exhaust passage;

a downstream side air-fuel ratio sensor provided between the upstream side catalyst and the downstream side catalyst in the exhaust passage; and a control device configured to control an air-fuel ratio of an exhaust gas flowing into the upstream side catalyst as air-fuel ratio control, wherein the control device is further configured to:

switch the air-fuel ratio of the exhaust gas flowing into the upstream side catalyst to a lean air-fuel ratio leaner than a stoichiometric air-fuel ratio when an output air-fuel ratio of the downstream side air-fuel ratio sensor becomes equal to or less than a constant rich judged air-fuel ratio richer than the stoichiometric air-fuel ratio and switch the air-fuel ratio of the exhaust gas flowing into the upstream side catalyst to a rich air-fuel ratio richer than the stoichiometric air-fuel ratio when an oxygen storage amount of the upstream side catalyst becomes a switching reference storage amount smaller than a maximum storable amount of oxygen; and make the concentration of $NO_X$ in the exhaust gas flowing into the upstream side catalyst increase without making the concentration of oxygen in the exhaust gas flowing into from the upstream side catalyst increase as control for increasing $NO_X$ when the oxygen storage amount of the downstream side catalyst becomes a predetermined limit storage amount smaller than the maximum storable amount of oxygen.

2. The exhaust purification system of an internal combustion engine according to claim 1, wherein the control device is further configured so as not to execute the control for increasing $NO_X$ even when the oxygen storage amount of the downstream side catalyst becomes the limit storage amount or less if a temperature of the downstream side catalyst is less than a predetermined temperature.

3. The exhaust purification system of an internal combustion engine according to claim 1, wherein the control device is further configured so as not to execute the control for increasing $NO_X$ even when the oxygen storage amount of the downstream side catalyst becomes the limit storage amount or less when the oxygen storage amount of the downstream side catalyst becomes the limit storage amount or less.

4. The exhaust purification system of an internal combustion engine according to claim 1, wherein the control device is further configured to control the air-fuel ratio of the exhaust gas flowing into the upstream side catalyst in the air-fuel ratio control so that the air-fuel ratio of the exhaust gas flowing out from the upstream side catalyst does not become a constant lean judged air-fuel ratio or more leaner than the stoichiometric air-fuel ratio, and wherein the lean judged air-fuel ratio is a lean air-fuel ratio with a difference from the stoichiometric air-fuel ratio equal to the difference between the rich judged air-fuel ratio and the stoichiometric air-fuel ratio.

5. The exhaust purification system of an internal combustion engine according to claim 1 further comprising a spark plug igniting an air-fuel mixture in a combustion chamber of the internal combustion engine, wherein the control device is further configured to make the timing of ignition of the air-fuel mixture by the spark plug advance and thereby make the concentration of $NO_x$ in the exhaust gas flowing into the upstream side catalyst increase in the control for increasing $NO_X$.

6. The exhaust purification system of an internal combustion engine according to claim 1 further comprising an EGR mechanism feeding part of the exhaust gas discharged from a combustion chamber of the internal combustion engine to the combustion chamber again, wherein the control device is further configured to use the EGR mechanism to make the amount of exhaust gas again fed to the combustion chamber decrease and thereby make the concentration of $NO_X$ in exhaust gas flowing into the upstream side catalyst increase in the control for increasing $NO_X$.

7. The exhaust purification system of an internal combustion engine according to claim 1 further comprising:

a cylinder fuel injector directly injecting fuel into a combustion chamber; and an intake passage fuel injector injecting fuel into an intake passage of the internal combustion engine, wherein the control device is further configured to:

be able to change a ratio of an amount of feed of fuel from the intake passage fuel injector to an amount of feed of fuel from the cylinder fuel injector, defined as an intake passage injection ratio; and make the intake passage injection ratio increase and thereby make a concentration of $NO_X$ flowing into the upstream side catalyst increase in the control for increasing $NO_X$.

8. An exhaust purification system of an internal combustion engine comprising:

an upstream side catalyst provided in an exhaust passage of the internal combustion engine;

a downstream side catalyst provided at a downstream side from the upstream side catalyst in a direction of exhaust flow in the exhaust passage;

a downstream side air-fuel ratio sensor provided between the upstream side catalyst and the downstream side catalyst in the exhaust passage; and a control device configured to control an air-fuel ratio of an exhaust gas flowing into the upstream side catalyst as air-fuel ratio control, wherein the control device is further configured to:

switch the air-fuel ratio of the exhaust gas flowing into the upstream side catalyst to a lean air-fuel ratio leaner than a stoichiometric air-fuel ratio when an output air-fuel ratio of the downstream side air-fuel ratio sensor becomes equal to or less than a constant rich judged air-fuel ratio richer than the stoichiometric air-fuel ratio and switch the air-fuel ratio of the exhaust gas flowing into the upstream side catalyst to a rich air-fuel ratio richer than the stoichiometric air-fuel ratio when an oxygen storage amount of the upstream side catalyst becomes a switching reference storage amount smaller than a maximum storable amount of oxygen;

make the concentration of $NO_X$ in the exhaust gas flowing into the upstream side catalyst increase without making the concentration of oxygen in the exhaust gas flowing out the upstream side catalyst increase as control for increasing $NO_X$ when the oxygen storage amount of the downstream side catalyst becomes a predetermined limit storage amount smaller than the maximum storable amount of oxygen; and not execute the control for increasing $NO_X$ even when the oxygen storage amount of the downstream side catalyst becomes the limit storage amount or less if a temperature of the downstream side catalyst is less than a predetermined temperature.

9. An exhaust purification system of an internal combustion engine comprising:

an upstream side catalyst provided in an exhaust passage of the internal combustion engine;

a downstream side catalyst provided at a downstream side from the upstream side catalyst in a direction of exhaust flow in the exhaust passage;

a downstream side air-fuel ratio sensor provided between the upstream side catalyst and the downstream side catalyst in the exhaust passage; and a control device configured to control an air-fuel ratio of an exhaust gas flowing into the upstream side catalyst as air-fuel ratio control, wherein the control device is further configured to:

switch the air-fuel ratio of the exhaust gas flowing into the upstream side catalyst to a lean air-fuel ratio leaner than a stoichiometric air-fuel ratio when an output air-fuel ratio of the downstream side air-fuel ratio sensor becomes equal to or less than a constant rich judged air-fuel ratio richer than the stoichiometric air-fuel ratio and switch the air-fuel ratio of the exhaust gas flowing into the upstream side catalyst to a rich air-fuel ratio richer than the stoichiometric air-fuel ratio when an oxygen storage amount of the upstream side catalyst becomes a switching reference storage amount smaller than a maximum storable amount of oxygen;

make the concentration of $NO_X$ in the exhaust gas flowing into the upstream side catalyst increase without making the concentration of oxygen in the exhaust gas flowing out the upstream side catalyst increase as control for increasing $NO_X$ when the oxygen storage amount of the downstream side catalyst becomes a predetermined limit storage amount smaller than the maximum storable amount of oxygen; and not execute the control for increasing $NO_X$ even when the oxygen storage amount of the downstream side catalyst becomes the limit storage amount or less when the oxygen storage amount of the downstream side catalyst becomes the limit storage amount or less.

10. An exhaust purification system of an internal combustion engine comprising:

an upstream side catalyst provided in an exhaust passage of the internal combustion engine;

a downstream side catalyst provided at a downstream side from the upstream side catalyst in a direction of exhaust flow in the exhaust passage;

a downstream side air-fuel ratio sensor provided between the upstream side catalyst and the downstream side catalyst in the exhaust passage;

a cylinder fuel injector directly injecting fuel into a combustion chamber; and an intake passage fuel injector injecting fuel into an intake passage of the internal combustion engine, and a control device configured to control an air-fuel ratio of an exhaust gas flowing into the upstream side catalyst as air-fuel ratio control, wherein the control device is further configured to:

switch the air-fuel ratio of the exhaust gas flowing into the upstream side catalyst to a lean air-fuel ratio leaner than a stoichiometric air-fuel ratio when an output air-fuel ratio of the downstream side air-fuel ratio sensor becomes equal to or less than a constant rich judged air-fuel ratio richer than the stoichiometric air-fuel ratio and switch the air-fuel ratio of the exhaust gas flowing into the upstream side catalyst to a rich air-fuel ratio richer than the stoichiometric air-fuel ratio when an oxygen storage amount of the upstream side catalyst becomes a switching reference storage amount smaller than a maximum storable amount of oxygen;

make the concentration of $NO_X$ in the exhaust gas flowing into the upstream side catalyst increase without making the concentration of oxygen in the exhaust gas flowing out the upstream side catalyst increase as control for increasing $NO_X$ when the oxygen storage amount of the downstream side catalyst becomes a predetermined limit storage amount smaller than the maximum storable amount of oxygen;

be able to change a ratio of an amount of feed of fuel from the intake passage fuel injector to an amount of feed of fuel from the cylinder fuel injector, defined as an intake passage injection ratio; and make the intake passage injection ratio increase and thereby make a concentration of $NO_X$ flowing into the upstream side catalyst increase in the control for increasing $NO_X$.

* * * * *